US011520276B2

(12) United States Patent
Ebe et al.

(10) Patent No.: US 11,520,276 B2
(45) Date of Patent: Dec. 6, 2022

(54) CHARGING DEVICE, IMAGE FORMING UNIT, IMAGE FORMING APPARATUS, AND METHOD OF MANUFACTURING CLEANING MEMBER

(71) Applicant: Oki Electric Industry Co., Ltd., Tokyo (JP)

(72) Inventors: Takaaki Ebe, Tokyo (JP); Yoshihiro Hashimoto, Tokyo (JP); Daiki Morimoto, Tokyo (JP)

(73) Assignee: Oki Electric Industry Co, Ltd., Tokyo (JP)

( * ) Notice: Subject to any disclaimer, the term of this patent is extended or adjusted under 35 U.S.C. 154(b) by 0 days.

(21) Appl. No.: 17/404,556

(22) Filed: Aug. 17, 2021

(65) Prior Publication Data

US 2022/0137544 A1 May 5, 2022

(30) Foreign Application Priority Data

Oct. 29, 2020 (JP) ..... JP2020-181814

(51) Int. Cl.
*G03G 15/02* (2006.01)
*G03G 21/00* (2006.01)

(52) U.S. Cl.
CPC ..... *G03G 21/0041* (2013.01); *G03G 21/0058* (2013.01)

(58) Field of Classification Search
CPC ..... G03G 15/0225; G03G 15/0258
USPC ..... 399/100
See application file for complete search history.

(56) References Cited

U.S. PATENT DOCUMENTS

| | | | | |
|---|---|---|---|---|
| 8,526,843 | B2 * | 9/2013 | Terai et al. | G03G 15/0225 399/100 |
| 10,031,467 | B2 * | 7/2018 | Yada et al. | G03G 15/0225 |
| 2012/0002998 | A1 * | 1/2012 | Kawai | G03G 21/0058 399/100 |
| 2013/0089354 | A1 | 4/2013 | Kano et al. | |
| 2014/0037320 | A1 * | 2/2014 | Berens | G03G 15/0225 399/100 |

FOREIGN PATENT DOCUMENTS

| | | | |
|---|---|---|---|
| JP | H09114201 | A | 5/1997 |
| JP | 2008116834 | A | 5/2008 |
| JP | 2012194457 | A | 10/2012 |
| JP | 2015152863 | A | 8/2015 |
| JP | 2016065971 | A | 4/2016 |
| JP | 2017058641 | A | 3/2017 |
| JP | 2017-083643 | A | 5/2017 |

* cited by examiner

*Primary Examiner* — William J Royer
(74) *Attorney, Agent, or Firm* — Rabin & Berdo, P.C.

(57) ABSTRACT

A charging device includes a charging member that is rotatable and contacts and electrically charges a surface of a charging target member; and a cleaning member that is rotatable and cleans a surface of the charging member, wherein the cleaning member includes a core bar extending in a lengthwise direction, a foam member that is helically wound around the core bar while forming a gap in the lengthwise direction and contacts the charging member, and a first adhesive agent that is provided between the foam member and the core bar, the first adhesive agent contacting a part of the foam member and another part of the foam member that are formed to adjoin each other in the lengthwise direction via the gap.

13 Claims, 13 Drawing Sheets

FIG. 18

TB1

| | ELASTIC LAYER THICKNESS D [mm] | ELASTIC LAYER WINDING INTERVAL Gb [mm] | BLACK DOT |
|---|---|---|---|
| EXAMPLE 1 | 0.875 | 0.00 | NON-OCCURRENCE |
| EXAMPLE 2 | 0.875 | 0.14 | NON-OCCURRENCE |
| EXAMPLE 3 | 0.875 | 0.19 | NON-OCCURRENCE |
| EXAMPLE 4 | 0.900 | 0.15 | NON-OCCURRENCE |
| EXAMPLE 5 | 0.900 | 0.17 | NON-OCCURRENCE |
| EXAMPLE 6 | 0.900 | 0.21 | NON-OCCURRENCE |
| EXAMPLE 7 | 0.950 | 0.00 | NON-OCCURRENCE |
| EXAMPLE 8 | 0.950 | 0.15 | NON-OCCURRENCE |
| EXAMPLE 9 | 0.950 | 0.19 | NON-OCCURRENCE |
| EXAMPLE 10 | 0.950 | 0.20 | NON-OCCURRENCE |
| EXAMPLE 11 | 0.950 | 0.23 | NON-OCCURRENCE |
| EXAMPLE 12 | 1.000 | 0.14 | NON-OCCURRENCE |
| EXAMPLE 13 | 1.000 | 0.19 | NON-OCCURRENCE |
| EXAMPLE 14 | 1.000 | 0.20 | NON-OCCURRENCE |
| EXAMPLE 15 | 1.000 | 0.25 | NON-OCCURRENCE |
| EXAMPLE 16 | 1.050 | 0.00 | NON-OCCURRENCE |
| EXAMPLE 17 | 1.050 | 0.15 | NON-OCCURRENCE |
| EXAMPLE 18 | 1.050 | 0.18 | NON-OCCURRENCE |
| EXAMPLE 19 | 1.050 | 0.26 | NON-OCCURRENCE |
| EXAMPLE 20 | 1.050 | 0.30 | NON-OCCURRENCE |

FIG. 19

TB2

| | ELASTIC LAYER THICKNESS D [mm] | ELASTIC LAYER WINDING INTERVAL Gb [mm] | BLACK DOT |
|---|---|---|---|
| COMPARATIVE EXAMPLE 1 | 0. 875 | 0. 23 | OCCURRENCE |
| COMPARATIVE EXAMPLE 2 | 0. 875 | 0. 25 | OCCURRENCE |
| COMPARATIVE EXAMPLE 3 | 0. 875 | 0. 30 | OCCURRENCE |
| COMPARATIVE EXAMPLE 4 | 0. 900 | 0. 25 | OCCURRENCE |
| COMPARATIVE EXAMPLE 5 | 0. 900 | 0. 30 | OCCURRENCE |
| COMPARATIVE EXAMPLE 6 | 0. 950 | 0. 26 | OCCURRENCE |
| COMPARATIVE EXAMPLE 7 | 0. 950 | 0. 30 | OCCURRENCE |
| COMPARATIVE EXAMPLE 8 | 1. 000 | 0. 30 | OCCURRENCE |
| COMPARATIVE EXAMPLE 9 | 1. 050 | 0. 40 | OCCURRENCE |

FIG. 20

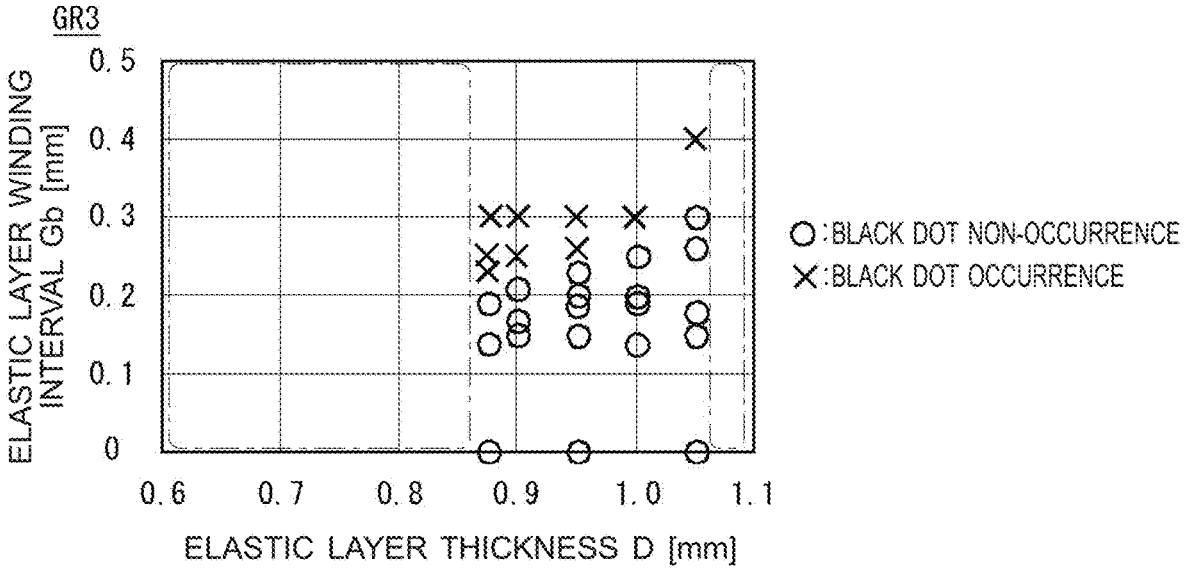

CHARGING DEVICE, IMAGE FORMING UNIT, IMAGE FORMING APPARATUS, AND METHOD OF MANUFACTURING CLEANING MEMBER

BACKGROUND OF THE INVENTION

1. Field of the Invention

The disclosure relates to a charging device, an image forming unit, an image forming apparatus, and a method of manufacturing a cleaning member.

2. Description of the Related Art

Conventionally, among image forming apparatuses employing an electrophotographic process such as printers, copy machines, facsimile machines and Multi-Function Peripherals (MFPs), there have been widely used image forming apparatuses of a contact charging type in which a charging member (charging roller, for example) is in contact with the surface of a photosensitive drum as a charging target member and thereby uniformly charges the surface of the charging target member.

In the image forming apparatuses of the contact charging type, the charging member directly contacts the charging target member, and thus there are cases where dirt such as an external additive of a developing agent (toner) adhering to the surface of the charging target member is flung up by the charging member and adheres to the surface of the charging member. The adhesion of the external additive to the surface of the charging member leads to a change in the charging condition of the surface of the charging target member.

To deal with this problem, there are cases where an image forming apparatus stably charges the surface of the photosensitive drum by employing a cleaning member for cleaning the surface of the charging roller by making contact with the surface of the charging roller and removing foreign matter such as the external additive. As this cleaning member, a cleaning roller including an elastic layer made of a foam material is widely used. See Japanese Patent Application Publication No. 2017-83643, for example.

However, there are cases where foreign matter from the cleaning member adheres to the charging member and that causes a printing defect.

SUMMARY OF THE INVENTION

An object of the disclosure is to propose a charging device, an image forming unit, an image forming apparatus, and a method of manufacturing a cleaning member with which high print quality can be maintained.

A charging device of the disclosure includes: a charging member that is rotatable and contacts and electrically charges a surface of a charging target member; and a cleaning member that is rotatable and cleans a surface of the charging member, wherein the cleaning member includes a core bar extending in a lengthwise direction, a foam member that is helically wound around the core bar while forming a gap in the lengthwise direction and contacts the charging member, and a first adhesive agent that is provided between the foam member and the core bar, the first adhesive agent contacting a part of the foam member and another part of the foam member that are formed to adjoin each other in the lengthwise direction via the gap.

An image forming unit of the disclosure includes the above-mentioned charging device.

An image forming apparatus of the disclosure includes the above-mentioned image forming unit.

A method of manufacturing a cleaning member of the disclosure, includes: sticking a belt-like first adhesive agent on a surface of a core bar by helically winding the belt-like first adhesive agent around the core bar while forming a first gap between opposite sides of the belt-like first adhesive agent in a lengthwise direction of the core bar; and bonding a belt-like foam member to the core bar by helically winding the belt-like foam member around the core bar so that the belt-like first adhesive agent contacts a part of the belt-like foam member and another part of the belt-like foam member that are formed to adjoin each other in the lengthwise direction of the core bar via a second gap.

According to the disclosure, foreign matter from the adhesive agent can be sandwiched between adjoining elastic members at the gap, the foreign matter can be prevented from being exposed on the surface of the cleaning member, the foreign matter from the cleaning member can be inhibited from adhering to the charging member, and the occurrence of the printing defect can be inhibited.

According to the disclosure, it is possible to realize a charging device, an image forming unit, an image forming apparatus, and a method of manufacturing a cleaning member with which high print quality can be maintained.

BRIEF DESCRIPTION OF THE DRAWINGS

In the drawings,

FIG. 18 shows a table of an evaluation result (1);

FIG. 19 shows a table of an evaluation result (2);

FIG. 20 is a graph showing a relationship between an elastic layer thickness and the elastic layer winding interval;

DETAILED DESCRIPTION OF THE INVENTION

Embodiments will be described below by using the drawings.

1. First Embodiment

[1-1. Configuration of Image Forming Apparatus]

Figure 1:
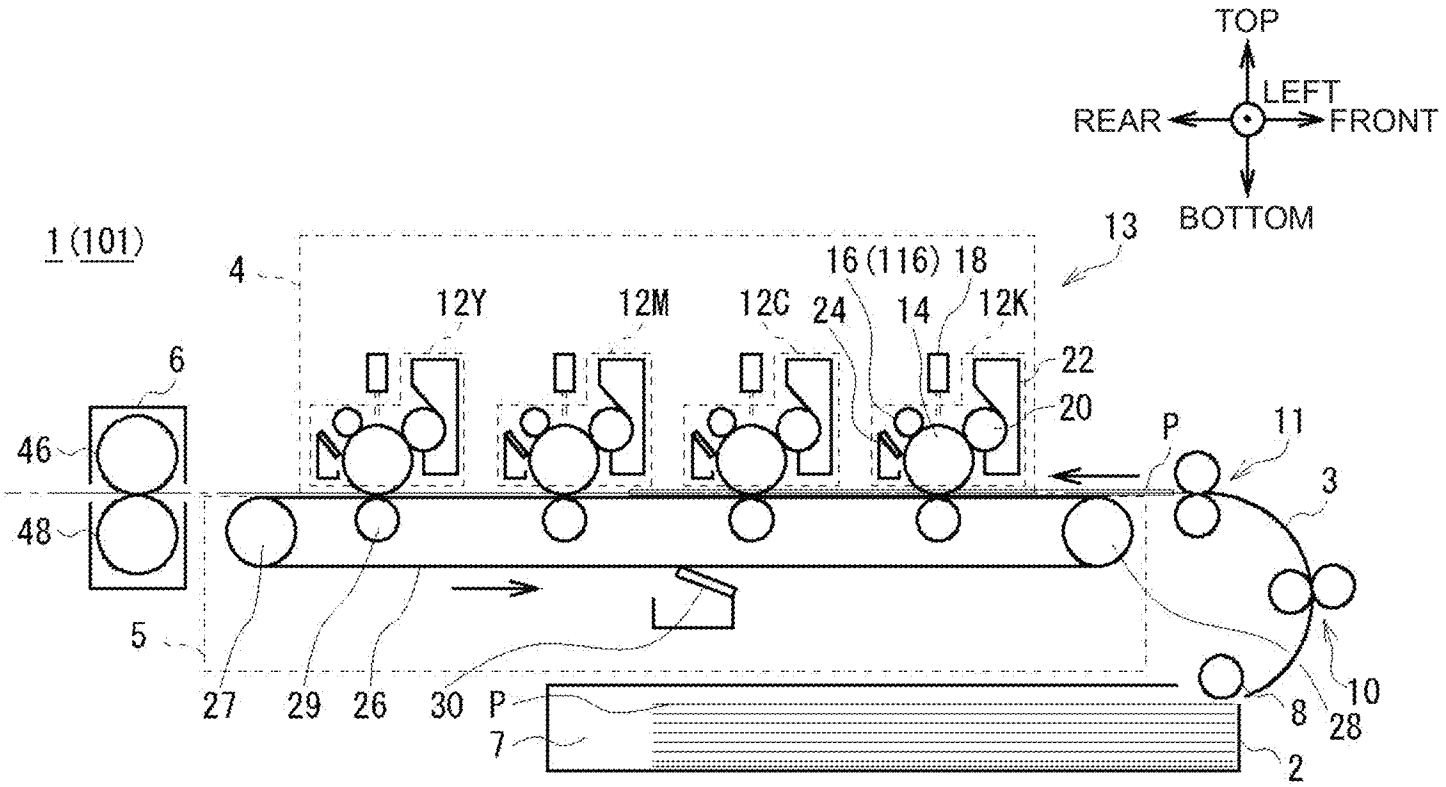
FIG. 1 is a left side view showing an internal configuration of an image forming apparatus according the embodiments.

As shown in FIG. 1, an image forming apparatus 1 is a printer using the electrophotographic method, for example, and forms a black and white image or a color image on a medium P such as paper or film by performing an image forming operation by using one or more developing agents such as toners. In the following description, a position close to a cassette 7 or a direction heading towards the cassette 7 as viewed from an arbitrary position in a conveyance path through which the medium P is conveyed will be referred to as an upper stream or being upstream. Further, a position close to a stacker onto which the medium P is ejected and loaded or a direction heading towards the stacker as viewed from an arbitrary position in the conveyance path will be referred to as a lower stream or being downstream. Furthermore, a direction heading from the upper stream towards the lower stream will be referred to as a conveyance direction. In a box-shaped housing, the image forming apparatus 1 includes a medium supply unit 2, a conveyance unit 3, an image forming section 4, a transfer unit 5 and a fixing unit 6 arranged from the upper stream towards the lower stream.

[1-2. Configuration of Medium Supply Unit]

The medium supply unit 2 includes the cassette 7 and a hopping roller 8. The cassette 7 is attached to a lower part of the housing of the image forming apparatus 1 in a detachable manner and stores media P in a stacked state. The hopping roller 8 separates and extracts the media P sheet by sheet from an uppermost part of the stack of media P stored in the cassette 7 and sends out the extracted medium P towards a conveyance roller pair 10 situated downstream of the hopping roller 8.

[1-3. Configuration of Conveyance Unit]

The conveyance unit 3 includes conveyance roller pairs 10 and 11 successively arranged from the upper stream towards the lower stream. The conveyance roller pairs 10 and 11 sandwich and convey the medium P sent out from the hopping roller 8 while correcting the skewing of the medium P and then convey the medium P in the conveyance direction towards a transfer belt 26.

[1-4. Configuration of Image Forming Section]

The image forming section 4 includes four development units 12 (12K, 12C, 12M and 12Y), for example. The development units 12K, 12C, 12M and 12Y are successively arranged in the conveyance direction from the upstream side towards the downstream side and form developing agent images (toner images) on the medium P by using toners (developing agents) of colors different from each other. Specifically, the development units 12K, 12C, 12M and 12Y respectively form toner images of black color, cyan color, magenta color and yellow color by using black, cyan, magenta and yellow toners.

Each of the toners used in this embodiment is a nonmagnetic one-component negatively changed toner that is made by adding an external additive agent such as inorganic fine powder or organic fine powder (hereinafter referred to as an external additive) to toner base particles including at least binder resin. While this binder resin is not particularly limited, polyester-based resin, styrene-acrylic-based resin, epoxy-based resin or styrene-butadiene-based resin is desirable. To this binder resin, a mold releasing agent, a coloring agent, etc, are added, and an additive agent such as a charging control agent, an electric conductivity adjuster, a fluidity increasing agent or a cleanability increasing agent may be further added properly. As the binder resin, a mixture of multiple types of binder resins is also usable, and in this embodiment, a crystalline polyester resin having crystal structure is used in addition to a plurality of amorphous polyester-based resins. The average particle diameter of the toner is 6.0 [μm] and the circularity of the toner particles is 0.96. Incidentally, the average particle diameter is measured by using a Coulter Multisizer III (manufactured by Backman Coulter Inc.), and the circularity is measured by using a flow particle image analyzer FPIA-3000 (manufactured by Sysmex Corporation).

While the mold releasing agent is not particularly limited, publicly known mold releasing agents are usable, such as low molecular weight polyethylene, low molecular weight polypropylene, copolymer of olefins, aliphatic hydrocarbon-based wax such as microcrystalline wax, paraffin wax or Fischer-Tropsch wax, oxide of aliphatic hydrocarbon-based wax such as oxidized polyethylene wax, block copolymer of these materials, waxes containing fatty acid ester as the main component such as carnauba wax and montan acid ester wax, and waxes obtained by partially or totally deoxidizing fatty acid esters such as deoxidized carnauba wax. As for the content of the mold releasing agent, adding 0.1 to 20 pts.wt. or preferably 0.5 to 12 pts.wt. of the mold releasing agent to 100 pts.wt. of the binder resin is effective, and using multiple types of waxes together is also desirable.

While the coloring agent is not particularly limited, it is possible to use one of pigments, dyes, etc. used as coloring agents for conventional black, yellow, magenta and cyan toners or two or more of such materials together, and examples of such materials include carbon black, iron oxide, Phthalocyanine Blue, Permanent Brown FG, Brilliant Fast Scarlet, Pigment Green B, Rhodamine B base, Solvent Red 49, Solvent Red 146, Pigment Blue 15:3, Solvent Blue 35, quinacridone, Carmine 6B, Disazo Yellow, and so forth. As for the content of the coloring agent, 2 to 25 pts.wt. or preferably 2 to 15 pts.wt. of the coloring agent is added to 100 pts.wt. of the binder resin.

As the charging control agent, a publicly known agent is usable. For a negatively charged toner, for example, an azo-based complex charging control agent, a salicylic acid-based complex charging control agent, a calixarene-based complex charging control agent, and so forth are usable. As for the content of the charging control agent, 0.05 to 15 pts.wt. or preferably 0.1 to 10 pts.wt. of the charging control agent is added to 100 pts.wt. of the binder resin.

The external additive in the toner is added in order to improve environmental stability, charging stability, development quality, fluidity and preservability, and publicly known external additives are usable. As for the content of the external additive, 0.01 to 10 pts.wt. or preferably 0.05 to 8 pts.wt. of the external additive is added to 100 pts.wt. of the binder resin. In this embodiment, some types of silica (of positive and negative charging polarities) 14 [μm] in the average particle diameter, colloidal silica (negatively charged) 110 [μm] in the average particle diameter, and melamine (positively charged) 200 [μm] in the average particle diameter are added to 100 pts.wt. of the base particles so that the total amount of the external additive is within the aforementioned range.

An electrification amount (blowoff electrification amount) of the toner is measured by stirring the toner and a carrier by means of shaking. In this measurement, a ferrite carrier EF96-35 (manufactured by Powdertech Co., Ltd.) is used as the carrier, and 0.5 [g] of the toner and 9.5 [g] of the carrier are mixed together. The mixture of the toner and the carrier (150 [mg]) is stored in a container and is shaken by using a shaker YS-LD (manufactured by YAYOI Co., Ltd.). The frequency of shaking is set at 200 [times/minute] and the shaking time is set at 300 seconds. After the shaking, suction is performed on the mixture for 10 seconds by using a powder electrification amount measurement device TB-203 (manufactured by KYOCERA Chemical Corporation) and setting blow pressure at 7.0 [kPa] and suction pressure at −4.5 [kPa], in which the electrification amount and a suction amount are outputted to a PC(Personal Computer) at 0.1 second intervals. The electrification amount Q/M of the toner particles per unit weight, calculated from average values of the electrification amounts and the suction amounts outputted in the last two seconds of the suction time (10 seconds), is approximately −35 [μC/g]. Incidentally, the measurement is conducted at a temperature of 25 [° C.] and a relative humidity of 50%.

[1-4-1. Configuration of Development Unit]

The development units 12K, 12C, 12M and 12Y have the same configuration except for forming the toner images by using toners of colors different from each other. In the following description, the development units 12K, 12C, 12M and 12Y are also referred to collectively as development units 12. Each development unit 12 includes a photosensitive drum 14, a charging device 16, an exposure device 18, a development roller 20, a toner supply unit 22 and a cleaning blade 24, for example.

[1-4-1-1. Configuration of Photosensitive Drum]

The photosensitive drum 14, as a member for bearing and carrying an electrostatic latent image on its surface (surface part), is formed by using a photo conductor (e.g., organic photo conductor). Specifically, the photosensitive drum 14 includes an electrically conductive support and a photoconductive layer covering the outer circumference (surface) of the electrically conductive support. The electrically conductive support is formed with a metallic pipe made of aluminum or stainless steel, for example. The photoconductive layer has structure in which a charge generation layer and a charge transport layer are stacked in turn, for example. The photosensitive drum 14 rotates at a predetermined circumferential speed.

The charge generation layer includes a charge generation material and binder resin as main components. As the charge generation material, various types of organic pigments and organic dyes are usable. Above all, metal-free phthalocyanine, phthalocyanines with a ligand made of metal such as copper, indium chloride, gallium chloride, tin, oxytitanium, zinc or vanadium, oxide of the metal or chloride of the metal, azo pigment such as monoazo, bisazo, trisazo and polyazos, and so forth are desirable.

The charge generation layer is used as a dispersion layer formed by binding fine particles of these charge generation materials by using various types of binder resins such as polyester resin, polyvinyl acetate, polyacrylic acid ester, polymethacrylic acid ester, polyester, polycarbonate, polyvinyl acetoacetal, polyvinyl propional, polyvinyl butyral, phenoxy resin, epoxy resin, urethane resin, cellulose ester or cellulose ether, for example.

The charge transport layer includes a charge transport material and binder resin as main components. Materials used as the charge transport material are, for example, electron donating materials such as heterocyclic compounds like carbazole, indole, imidazole, oxazole, pyrazole, oxadiazole, pyrazoline and thiadiazole, aniline derivatives, hydrazone compounds, aromatic amine derivatives, stilbene derivatives, and polymers including a group made of one of these compounds in its principal chain or side chain. As the binder resin in the charge transport layer, usable materials are vinyl polymers such as polycarbonate, polymethylmethacrylate, polystyrene and polyvinyl chloride, polyester, polyester carbonate, polysulfone, polyimide, phenoxy, epoxy, silicone resin, polymers of these materials, partially crosslinked cured products of these materials, and so forth, in which polycarbonate is especially desirable. Further, the binder resin in the charge transport layer may include some types of additives such as an antioxidant and a sensitizer as needed.

[1-4-1-2. Configuration of Charging Device]

Figure 2:
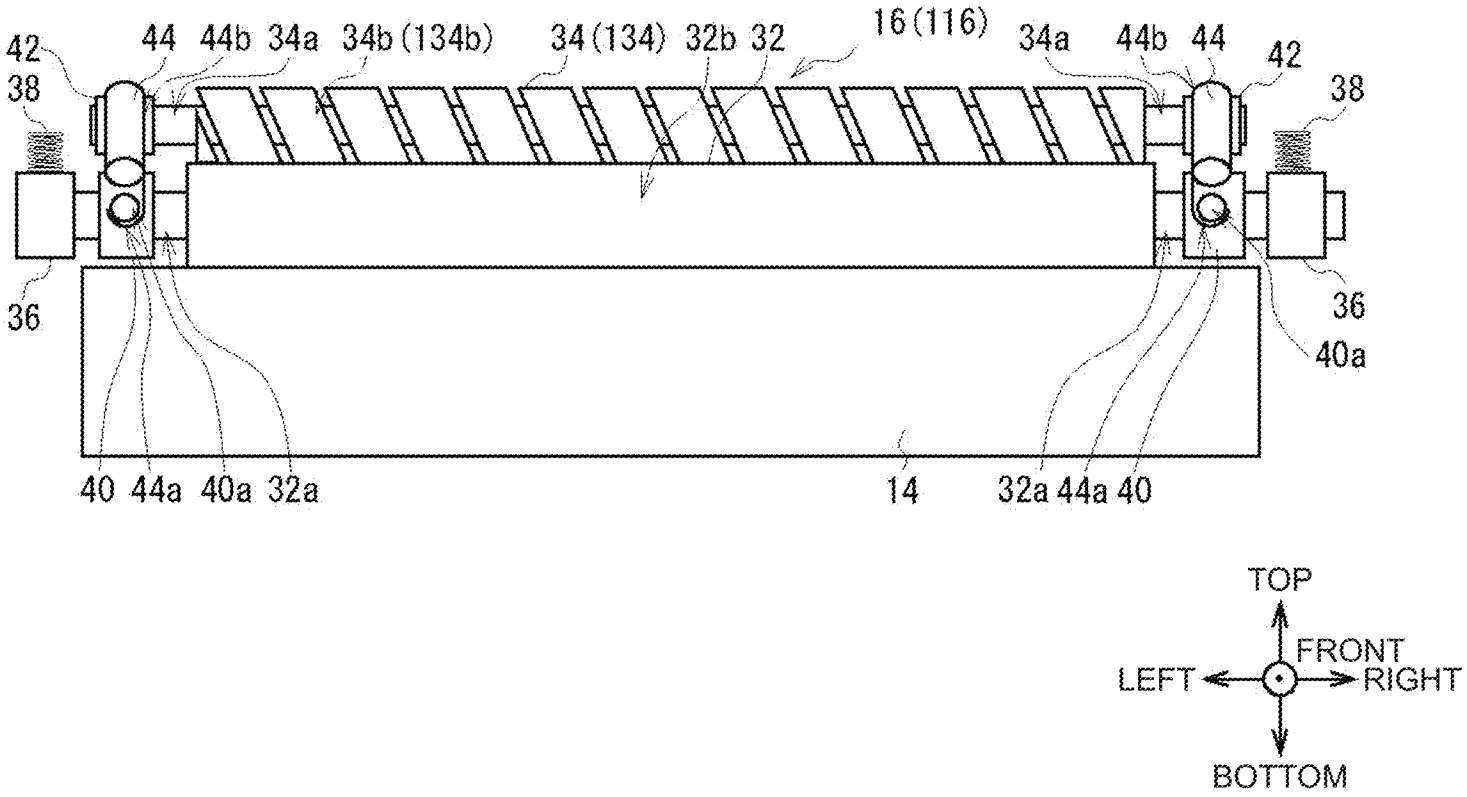
FIG. 2 is a front view showing a configuration (1) of a charging device of FIG. 1.
Figure 3:
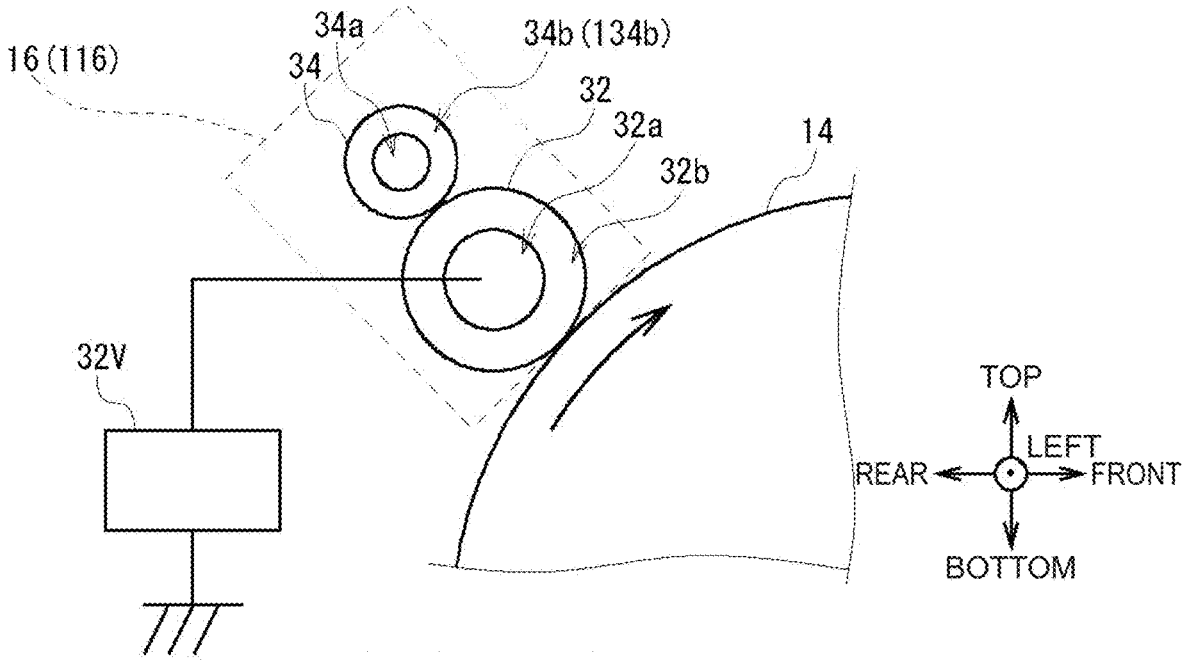
FIG. 3 is a left side view showing a configuration (2) of the charging device of FIG. 2.

As shown in FIG. 2 and FIG. 3, the charging device 16 is a device for electrically charging the surface of the photosensitive drum 14 as the charging target member, and is formed mainly with a charging roller 32 as a charging member and a cleaning roller 34 as a cleaning member. The charging roller 32 is arranged with its rotation axis pointed in a transverse direction so as to contact the surface of the photosensitive drum 14. A charging roller core bar 32*a* of this charging roller 32 is rotatably supported by outside charging roller bearings 36 provided in the vicinity of left and right ends of the charging roller 32. The outside charging roller bearings 36 are biased towards the photosensitive drum 14 by compression springs 38. Accordingly, the charging roller 32 is biased towards the photosensitive drum 14. Further, inside charging roller bearings 40 rotatably supporting the charging roller core bar 32*a* are respective provided inside the left and right outside charging roller bearings 36 in the transverse direction. From each of the inside charging roller bearings 40, bearing arms 40*a* in substantially cylindrical and straight shapes respectively project in a forward and upward direction and a rearward and upward direction from positions slightly above vertical direction centers of front and back side faces of the inside charging roller bearing 40.

The cleaning roller 34 is arranged with its rotation axis pointed in the transverse direction so as to contact and slide on the charging roller 32. A cleaning roller core bar 34*a* of this cleaning roller 34 is rotatably supported by cleaning roller bearings 42 provided in the vicinity of left and right ends of the cleaning roller 34. The cleaning roller 34 is driven to follow the rotation of the charging roller 32 due to friction between the surface of the charging roller 32 and the surface of the cleaning roller 34. A tension spring arm 44*a* of a tension spring 44 is engaged with a bearing arm 40*a* of each inside charging roller bearing 40. This tension spring 44 is bent to be in a shape like a 180-degree inverted upper case character "U" as a whole, and winds an inner side of a bent shape of its tension spring coil part 44*b* in the bent state around an outer circumferential surface of the cleaning roller bearing 42 as a part of a circumferential side face of the cleaning roller bearing 42 on the side opposite to the charging roller 32. As above, the charging device 16 is configured to bend the tension spring 44 engaged with the inside charging roller bearing 40 and make the inner side of the bent shape contact the cleaning roller bearing 42 and thereby make the tension spring 44 pull the bearing arm 40*a* of the inside charging roller bearing 40 coaxial with the charging roller 32. Therefore, the charging device 16 is capable of biasing the cleaning roller 34 towards the charging roller 32 to be in contact with the charging roller 32 by biasing the cleaning roller bearings 42 towards the inside charging roller bearings 40 with the tension springs 44.

With a bearing part made up of the inside charging roller bearings 40, the cleaning roller bearings 42 and the tension springs 44, the charging device 16 is capable of making the cleaning roller 34 nip the charging roller 32 with a load and appropriately dealing with changes and fluctuations in the friction of the cleaning roller 34 and the wall thickness of a cleaning roller elastic layer 34*b*.

[1-4-1-2-1. Configuration of Charging Roller]

The charging roller 32 includes the charging roller core bar 32*a* made of material having electrical conductivity, and a charging roller elastic layer 32*b* that is electrically conductive is formed on an outer circumferential surface of the charging roller core bar 32*a*. For the charging roller core bar 32*a*, a metallic shaft made of SUM with electroless nickel plating, SUS, or the like is commonly used, for example. For the charging roller elastic layer 32*b*, rubber, thermoplastic elastomer, resin or the like is commonly used in order to achieve appropriate electric discharge between the charging roller 32 and the photosensitive drum 14 and enable the nipping between the charging roller 32 and the photosensitive drum 14. The charging roller elastic layer 32*b* is not limited to a single layer but can include a multilayer structure of two or more layers as needed.

As the material forming the charging roller elastic layer 32*b*, it is possible to use, for example, a rubber composition whose main component is one type of material or a mixture of two or more types of materials selected from epichlorohydrin rubber (CO, ECO, GECO), ethylene-propylene rubber (EPM, EPDM), acrylonitrile-butadiene rubber (NBR), hydrogenated acrylonitrile-butadiene rubber (H-NBR), styrene-butadiene rubber (SBR), butadiene rubber (BR), isoprene rubber (IR), chloroprene rubber (CR), urethane rubber, silicone rubber, etc. Above all, rubber including epichlorohydrin rubber (ECO) as the main component or rubber including a mixture of epichlorohydrin rubber (ECO) and acrylonitrile-butadiene rubber (NBR) as the main component is commonly used. In this embodiment, the rubber including epichlorohydrin rubber (ECO) as the main component is used.

As an electrical conduction property of the charging roller elastic layer 32*b*, too high resistance generally leads to uneven charging of the surface of the photosensitive drum 14 and an image defect due to the defective charging. In contrast, if the resistance is too low, leak current occurs due to a scar or the like on the surface of the photosensitive drum 14 and that leads to an image defect. Thus, an appropriate resistance region exists in the electrical conduction property of the charging roller elastic layer 32*b*. To achieve the appropriate resistance region, the charging roller elastic layer 32*b* is provided with a predetermined electrical conductivity by using an ion-conductive material, an ion conductive agent, carbon black, metallic oxide or the like. While either an electron-conductive material or an ion-conductive material is usable in terms of the electrical conduction property of the charging roller elastic layer 32*b*, partial resistance unevenness is apt to affect the uneven charging on the photosensitive drum 14, and thus an ion-conductive material is more commonly used than an electron-conductive material in order to inhibit the resistance unevenness.

A resistive layer whose volume resistance value is 106 to 109 [Ω] is desirable for the charging roller elastic layer 32*b*. While the resistance value of the charging roller 32 takes on different values depending on temperature, humidity and measurement voltage in cases of an ion-conductive material, values measured in an environment at a temperature of 20 [° C.] and a humidity of 50 [% RH] are shown here.

The hardness of the charging roller elastic layer 32*b* is required to form a minute gap between the surface of the charging roller 32 and the surface of the photosensitive drum 14 and secure a region contributing to the electric discharge according to the Paschen's law. The hardness of the charging roller elastic layer 32*b* is adjusted in order to obtain an appropriate nip. In this adjustment, peak measurement is performed in regard to the hardness of the charging roller elastic layer 32*b* by using a microrubber hardness gauge MD-1capa (Type A) (manufactured by Kobunshi Keiki Co., Ltd.). In this measurement, while the measurement value is desired to be within a range of 35° to 80°, the setting of this hardness range includes also a purpose of absorbing cylinder wobbling and shape irregularity of the charging roller 32 and the photosensitive drum 14, and thus it is unnecessary to adhere to these values as long as an appropriate nip is obtained between the charging roller 32 and the photosensitive drum 14.

In regard to the outer surface shape of the charging roller elastic layer 32*b*, predetermined types of polishing marks and surface roughness are formed due to cutting, a polishing process or molding. In this case, while the surface roughness of the charging roller 32 varies to some extent depending on the applied voltage and the use environment, the maximum height Ry (in conformity with Japanese Industrial Standards (JIS) B 0601: 1994) is desired to be in a range of approximately 1 [μm] to 40 [μm] according to the Paschen's law.

Surface treatment or coating can be performed on the outer surface of the charging roller elastic layer 32*b*. The surface treatment or coating enables the charging roller 32 to prevent substances contained in the charging roller elastic layer 32*b* from contaminating the photosensitive drum 14, adjust the surface resistance of the charging roller elastic layer 32*b*, provide the surface of the charging roller 32 with appropriate roughness so as to inhibit the toner and the toner external additive adhering to the photosensitive drum 14 from sticking to the surface, and so forth. As the surface treatment on the outer surface of the charging roller elastic layer 32*b*, surface treatment such as ultraviolet ray irradiation or electron beam irradiation may be performed, for example.

The coating can be performed by means of dipping, spraying, or coating by use of a coater or the like. As the coating material, it is possible to use, for example, one type of material or a combination of two or more types of materials selected from acrylic resin, urethane resin, fluororesin, polyamide resin, polycarbonate resin, polyester resin, isocyanate resin, etc. Besides the aforementioned materials, a conductive agent or the like may be added to the coating material as needed. These coating materials may also be further mixed with particles. As the mixed particles, it is possible to use, for example, one type of material or a combination of two or more types of materials selected from acrylic resin, urethane resin, fluororesin, polyamide resin, polycarbonate resin, polyester resin, isocyanate resin, etc.

Specifically, in the charging roller 32 in this embodiment, a metallic shaft made of free-cutting steel (SUM) with electroless nickel plating is used as the charging roller core bar 32*a*, and rubber including a mixture of epichlorohydrin rubber (ECO) and acrylonitrile-butadiene rubber (NBR) as the main component is used as the charging roller elastic layer 32*b*. The charging roller core bar 32*a* with an external diameter of ϕ6.0 [mm] and the charging roller elastic layer 32*b* with an external diameter of 9.5 [mm] are used.

The surface of the charging roller elastic layer 32*b* is formed by molding. For the coating on the charging roller elastic layer 32*b*, a mixed solvent of water and alcohol is used as the solvent, and a solution containing a mixture of a polyamide (nylon)-based polymer and urethane resin particles is applied and thereafter hardened by evaporation of the solvent. In that case, urethane resin particles 20 [μm] and 10 [μm] in diameter are contained in the solution.

[1-4-1-2-2. Configuration of Cleaning Roller]

Figure 5:
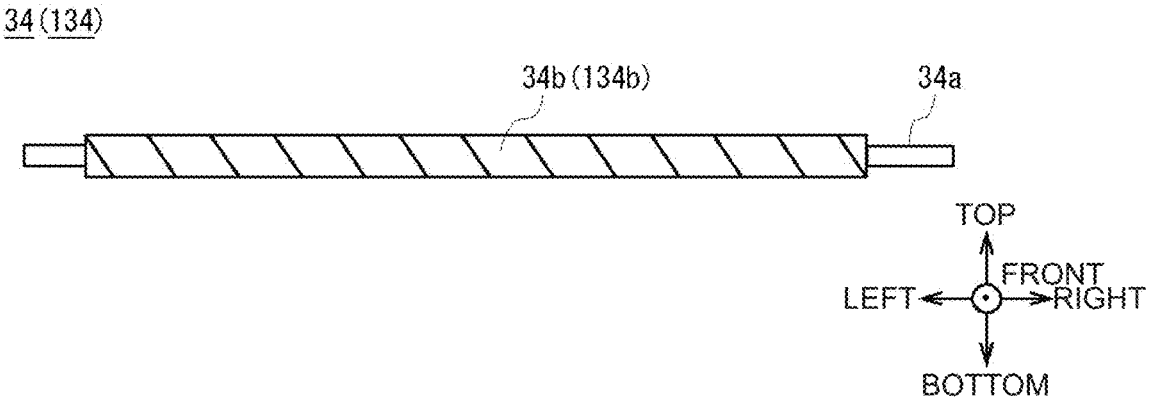
FIG. 5 is a front view showing a configuration of a cleaning roller of FIG. 2.
Figure 6:
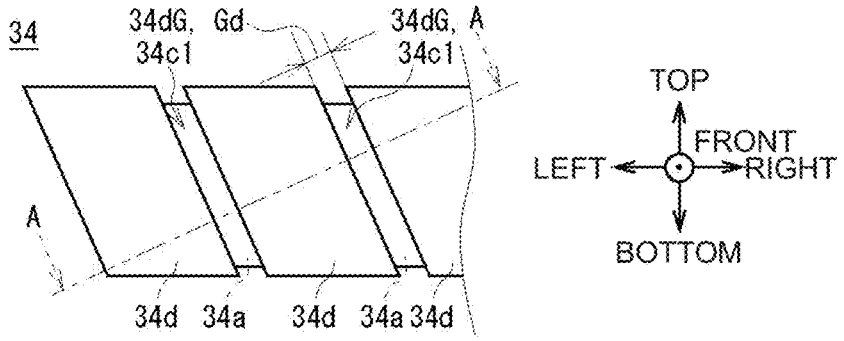
FIG. 6 is an enlarged front view showing a configuration (1) of the cleaning roller according to a first embodiment.
Figure 7:
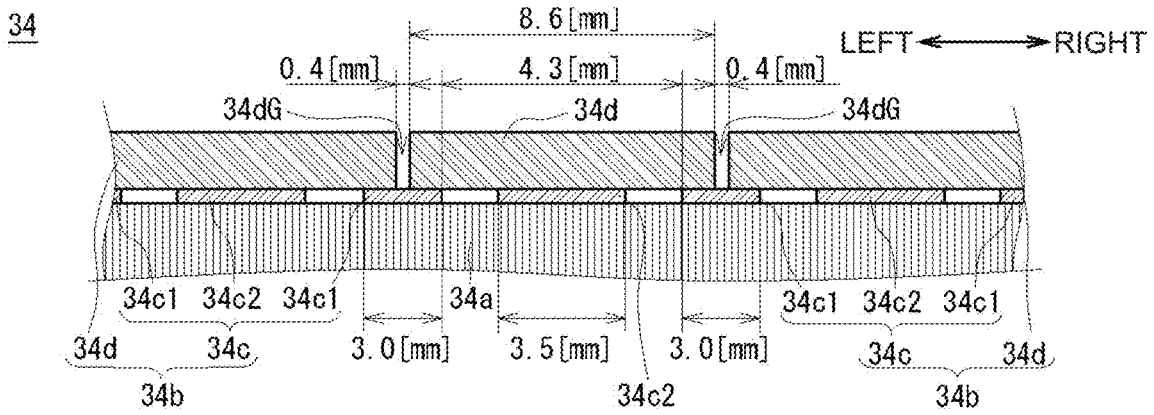
FIG. 7 is a cross-sectional view taken in an arrow direction of the line A-A in FIG. 6 and showing a configuration (2) of the cleaning roller according to the first embodiment.

As shown in FIG. 5, the cleaning roller 34 includes the cleaning roller core bar 34*a* and the cleaning roller elastic layer 34*b* provided on an outer circumferential surface of the cleaning roller core bar 34*a*. As shown in FIG. 7, the cleaning roller elastic layer 34*b* is formed with an adhesive agent 34*c* and a foam member 34*d*. For the cleaning roller core bar 34*a*, it is possible to use, for example, a metallic shaft made of SUM with electroless nickel plating, SUM or the like, resin such as polyacetal (POM), and so forth. As the configuration of the foam member 34*d*, either one layer or a multilayer configuration of two or more layers may be employed. Further, the foam member 34*d* may be either configured to include a foam material or configured with two layers: a solid layer and a foam layer. Furthermore, the foam member 34*d* is arranged to wind helically (in a helical manner or spiral manner) around substantially the whole of the surface of the cleaning roller core bar 34*a* excluding its end parts. As shown in FIG. 6, the foam member 34*d* in this embodiment is in a belt-like shape, and is wound around the surface of the cleaning roller core bar 34*a* while forming a foam member gap 34*d*G, i.e., a second gap between a part and another part (i.e., opposite sides) of the foam member 34*d* in regard to a lengthwise direction of the cleaning roller 34. The lengthwise direction of the cleaning roller 34 (transverse direction) will hereinafter be referred to also as a cleaning roller lengthwise direction. The interval at the foam member gap 34*d*G is a foam member winding interval Gd. The foam member winding interval Gd is an interval in a direction orthogonal to a long side of the foam member 34*d* in the belt-like shape and the other long side facing the former long side in regard to the cleaning roller lengthwise direction via the foam member gap 34*d*G.

A width of the foam member 34*d*, a width of a core bar-side adhesive agent 34*c*1, a width of a foam member-side adhesive agent 34*c*2, the foam member winding interval Gd, and an interval between the core bar-side adhesive agents 34*c*1 which will be described below also similarly represent lengths in the aforementioned direction of the foam member winding interval Gd.

As the material forming the foam member 34*d*, it is possible to use one type of material or a mixture of two or more types of materials selected from foamable resins such as polyurethane, polyethylene, polyamide and polypropylene and rubber materials such as silicone rubber, fluororubber, urethane rubber, ethylene-propylene rubber (EPM, EPDM), acrylonitrile-butadiene rubber (NBR), hydrogenated acrylonitrile-butadiene rubber (H-NBR), styrene-butadiene rubber (SBR), butadiene rubber (BR), isoprene rubber (IR) and chloroprene rubber (CR). To these materials, an auxiliary agent such as a foaming auxiliary, a foam stabilizer, a catalyst, a hardener, a plasticizer or a vulcanizing accelerator may be added as needed.

As shown in FIG. 7, the foam member 34*d* and the cleaning roller core bar 34*a* are bonded together by the core bar-side adhesive agent 34*c*1 and the foam member-side adhesive agent 34*c*2. The core bar-side adhesive agent 34*c*1 and the foam member-side adhesive agent 34*c*2 are the same material, and in the following description, the core bar-side adhesive agent 34*c*1 and the foam member-side adhesive agent 34*c*2 will also be referred to collectively as the adhesive agent 34*c*. With the foam member 34*d* and the adhesive agent 34*c*, the cleaning roller elastic layer 34*b* is formed. As the adhesive agent 34*c*, an adhesive made of adhesive tape such as double-stick tape is used, for example. For the adhesive of the adhesive tape, it is possible to use one type of adhesive or a combination of two or more types of adhesives selected from an acrylic-based adhesive, a rubber-based adhesive, a silicone-based adhesive, etc. The adhesive tape is usable irrespective of whether there is a base material or not. In the cleaning roller 34 used in this embodiment, a shaft made of free-cutting steel with electroless nickel plating is used as the material of the cleaning roller core bar 34*a*. For the foam member 34*d*, a polyurethane foam material, specifically, moltopren SM-55 manufactured by Inoac Corporation, is used. As for properties of moltopren SM-55 as the foam material, the density is 0.057±0.005 [g/cm$^3$] and the number of cells is (55±10 pcs)/(25 mm). The density and the number of cells are measured in conformity with JIS K 6400. The foam member-side adhesive agent 34*c*2 as double-stick tape is stuck on a back surface of a urethane foam material 8.6 [mm] wide as the foam member 34*d*, and the foam member 34*d* is helically wound around the cleaning roller core bar 34*a* while setting the foam member winding interval Gd of the foam member gap 34*d*G at 0.5 [mm] or less. As the adhesive agent 34*c*, an acrylic-based adhesive FFK145 (manufactured by Hong Kong FIT Co., Ltd., 0.145 [mm] thick) is used.

In this embodiment, the external diameter of the cleaning roller core bar 34*a* is 04.0 [mm], the width of the foam member 34*d* is 8.6 [mm], the width of the core bar-side adhesive agent 34*c*1 is 3.0 [mm], the width of the foam member-side adhesive agent 34*c*2 is 3.5 [mm], the foam member winding interval Gd is 0.4 [mm], and the interval between the core bar-side adhesive agents 34*c*1 is 3.5 [mm] or more (e.g., 4.3 [mm]). As above, the width of the core bar-side adhesive agent 34*c*1 is set greater than the foam member winding interval Gd. Further, the width of the foam member-side adhesive agent 34*c*2 is set less than the width of the foam member 34*d*.

As shown in FIG. 7, focusing on a region in the vicinity of one foam member gap 34*d*G, in the core bar-side adhesive agent 34*c*1, a long side on a leftward direction side is situated on the leftward direction relative to a right-side long side of the foam member 34*d* arranged on the leftward direction side of the foam member gap 34*d*G. Further, in the core bar-side adhesive agent 34*c*1, a long side on a rightward direction side is situated on the rightward direction relative to a left-side long side of the foam member 34*d* arranged on the rightward direction side of the foam member gap 34*d*G. Namely, in the core bar-side adhesive agent 34*c*1, an end on a first direction side in the cleaning roller lengthwise direction is situated on the first direction relative to an end of the foam member 34*d* arranged on the first direction side of the foam member gap 34*d*G on an opposite direction side in the cleaning roller lengthwise direction. Further, in the core bar-side adhesive agent 34*c*1, an end on the opposite direction side in the cleaning roller lengthwise direction is situated on the opposite direction relative to an end of the foam member 34*d* arranged on the opposite direction side of the foam member gap 34*d*G on the first direction side in the cleaning roller lengthwise direction.

Further, the core bar-side adhesive agent 34*c*1 is arranged continuously with no gap from the long side on the leftward direction side to the long side on the rightward direction side. Namely, the core bar-side adhesive agent 34*c*1 is arranged continuously with no gap from the end on the first direction side in the cleaning roller lengthwise direction to the end on the opposite direction side.

In other words, as viewed from a central part of the foam member gap 34*d*G, the leftward direction end of the core bar-side adhesive agent 34*c*1 is situated on a far side (leftward direction) relative to the rightward direction end of the foam member 34*d* on the leftward direction side of the foam member gap 34*d*G, and the right-ward direction end of the core bar-side adhesive agent 34*c*1 is situated on a far side (rightward direction) relative to the leftward direction end of the foam member 34*d* on the rightward direction side of the foam member gap 34*d*G. Namely, the first direction end of the core bar-side adhesive agent 34*c*1 in the cleaning roller lengthwise direction is situated on the first direction relative to the opposite direction end of the foam member 34*d* on the first direction side of the foam member gap 34*d*G, and the opposite direction end of the core bar-side adhesive agent 34*c*1 in the cleaning roller lengthwise direction is situated on the opposite direction relative to the first direction end of the foam member 34*d* on the opposite direction side of the foam member gap 34*d*G.

Therefore, both of the first direction end and the opposite direction end of the core bar-side adhesive agent 34*c*1 in the cleaning roller lengthwise direction go to the inside of the foam member 34*d* in regard to the width direction of the foam member 34*d* (the cleaning roller lengthwise direction) and are hidden as viewed from the outside of an outer circumferential part of the foam member 34*d*.

As above, the core bar-side adhesive agent 34*c*1 as viewed in a cross section is provided continuously to extend from the inside of one foam member 34*d* regarding the width direction to the inside of the other foam member 34*d* regarding the width direction in regard to a pair of foam members 34*d* adjoining each other in the cleaning roller lengthwise direction via the foam member gap 34*d*G.

In other words, as viewed in a cross section, a part of the core bar-side adhesive agent 34*c*1 is provided continuously from a first direction end to an opposite direction end of the foam member gap 34*d*G and is exposed to the outside of the foam member 34*d*, and the width of the core bar-side adhesive agent 34*c*1 is set greater than the foam member winding interval Gd.

Further, on the cleaning roller core bar 34*a*'s side of the foam member 34*d*, the position of a central part of the foam member-side adhesive agent 34*c*2 in a short-side direction (width direction) is registered with a central part of the foam member 34*d* in the short-side direction, and the width of the foam member-side adhesive agent 34*c*2 is set less than the width of the foam member 34*d*.

Therefore, focusing on the foam member-side adhesive agent 34*c*2 at one position, a long side of the foam member-side adhesive agent 34*c*2 on the leftward direction side is situated on the rightward direction relative to a long side of the foam member 34*d* on the leftward direction side. Further, a long side of the foam member-side adhesive agent 34*c*2 on the rightward direction side is situated on the leftward direction relative to a long side of the foam member 34*d* on the rightward direction side. Namely, an end of the foam member-side adhesive agent 34*c*2 on the first direction side in the cleaning roller lengthwise direction is situated on the opposite direction relative to an end of the foam member 34*d* on the first direction side in the cleaning roller lengthwise direction. Further, an end of the foam member-side adhesive agent 34*c*2 on the opposite direction side in the cleaning roller lengthwise direction is situated on the first direction relative to an end of the foam member 34*d* on the opposite direction side in the cleaning roller lengthwise direction.

In other words, as viewed from a central part of the foam member-side adhesive agent 34*c*2 and the foam member 34*d* in the short-side direction, the leftward direction end of the foam member-side adhesive agent 34*c*2 is situated on a near side (rightward direction) relative to the leftward direction end of the foam member 34*d*, and the rightward direction end of the foam member-side adhesive agent 34*c*2 is situated on a near side (leftward direction) relative to the rightward direction end of the foam member 34*d*. In other words, as viewed from the central part of the foam member-side adhesive agent 34*c*2 and the foam member 34*d* in the short-side direction, the first direction end of the foam member-side adhesive agent 34*c*2 in the cleaning roller lengthwise direction is situated on the opposite direction relative to the first direction end of the foam member 34*d*, and the opposite direction end of the foam member-side adhesive agent 34*c*2 in the cleaning roller lengthwise direction is situated on the first direction relative to the opposite direction end of the foam member 34*d*.

Therefore, both of the first direction end and the opposite direction end of the foam member-side adhesive agent 34*c*2 in the cleaning roller lengthwise direction are situated inside the foam member 34*d* in regard to the width direction of the foam member 34*d* (the cleaning roller lengthwise direction) and are hidden as viewed from the outside of the outer circumferential part of the foam member 34*d*.

[1-4-1-3. Configuration of Exposure Device]

The exposure device 18 (FIG. 1) is a device that exposes the surface of the photosensitive drum 14 to light by irradiating the surface with irradiation light and thereby forms an electrostatic latent image on the surface (surface part) of the photosensitive drum 14. This exposure device 18 is supported by the housing of the image forming apparatus 1, for example. The exposure device 18 is configured to include, for example, a plurality of light sources that emit the irradiation light and a lens array that focuses the irradiation light on the surface of the photosensitive drum 14 to form an image. Incidentally, as each of the light sources, a light-emitting diode (LED), a laser element or the like is usable, for example.

[1-4-1-4. Configuration of Development Roller]

The development roller 20, as a member that bears and carries the toner, for the development of the electrostatic latent image, on its surface, is arranged to contact the surface (circumferential surface) of the photosensitive drum 14. This development roller 20 includes, for example, a metallic shaft and a semiconductive urethane rubber layer covering the outer circumference (surface) of the metallic shaft. The development roller 20 is configured to rotate at a predetermined circumferential speed in a direction opposite to that of the photosensitive drum 14, for example. To this development roller 20, the toner stored in the toner supply unit 22 is supplied by a supply roller or the like.

[1-4-1-5. Configuration of Toner Supply Unit]

The toner supply unit 22 is a container storing the toner of each of the aforementioned colors. Namely, the toner supply units 22 of the development units 12K, 12C, 12M and 12Y respectively store a black toner, a cyan toner, a magenta toner and a yellow toner.

[1-4-1-6. Configuration of Cleaning Blade]

The cleaning blade 24 has an end in contact with the surface of the photosensitive drum 14 and scrapes off the toner remaining on the surface of the photosensitive drum 14 without being transferred onto the transfer belt 26. This cleaning blade 24 is made of flexible rubber material, plastic material or the like, for example.

The cleaning blade 24 is formed with a plate-like elastic body and an electrically conductive plate-like holder for holding the plate-like elastic body. While the material forming the plate-like elastic body is not particularly limited, an elastic composition is generally used so as not to damage the surface of the photosensitive drum 14 when sliding on the surface of the photosensitive drum 14 and scraping off the residual toner. As the material forming the plate-like elastic body, a composition made by adding an appropriate additive agent to polyurethane, silicone resin, fluororesin, fluororubber or the like is usable, for example. Above all, the polyurethane composition is ideal in terms of excellence in mechanical strength, elastic pressability, etc. This polyurethane composition can be obtained generally by use of polyisocyanate, polyol, a hardener and a catalyst. Polyisocyanate is not particularly limited and examples of polyisocyanate include diisocyanates such as 4,4'-diphenylmethanediisocyanate (MDI), 2,4-tolylene diisocyanate (2,4-TDI), 2,6-tolylene diisocyanate (2,6-TDI), 3,3'-tolylene-4,4'-diisocyanate, 3,3'-dimethyldiphenylmethane-4,4'-diisocyanato, 4,4'-diisocyanato-3,3'-dimethyldiphenylmethane, 2,4-tolylene diisocyanate uretidinedione (dimer of 2,4-TDI), 1,5-naphthylene diisocyanate, methaphenilene diisocyanate, hexamethylene diisocyanate, isophorone diisocyanate, 4,4-dicyclohexyl methane diisocyanate (hydrogenated MDI), carbodiimide-modified MDI, o-toluidine diisocyanate, xylene diisocyanate, p-phenylene diisocyanate and lysine diisocyanate methyl ester, triisocyanates such as triphenylmethane-4,4',4"-triisocyanate, polymeric MDI, and so forth. One type of material or a combination of two or more types of materials selected from these materials may be used. Above all, MDI is desirable as polyisocyanate from the viewpoint of wear resistance. The polyol used together with polyisocyanate is not particularly limited and examples of polyol include polyesterpolyols such as polyethylene adipate (PEA), polybutylene adipate (PBA) and polyhexylene adipate, and polyether polyols such as polycaprolactone, polyoxy tetramethylene glycol and polyoxy propylene glycol. One type of material or a combination of two or more types of materials selected from these materials may be used. Above all, PBA is desirable as polyol from the viewpoint of wear resistance. The hardener used together with polyisocyanate and polyol is not particularly limited and examples of the hardener include polyols with molecular weight of 300 or less such as 1,4-butanediol, ethylene glycol, diethylene glycol, propylene glycol, dipropylene glycol, hexanediol, 1,4-cyclohexanediol, 1,4-cyclohexanedimethanol, xylene glycol, triethylene glycol, trimethylolpropane, glycerin, pentaerythritol, sorbitol and 1,2,6-hexanetriol. One type of material or a combination of two or more types of materials selected from these materials may be used. Linear pressure of the cleaning blade 24 on the photosensitive drum 14 is desired to be higher than or equal to 15 [gf/cm] and lower than or equal to 30 [gf/cm], and is set at 20 [gf/cm] in this embodiment. The cleaning angle as set within 10 to 15 degrees.

[1-5. Configuration of Transfer Unit]

The transfer unit 5 includes the transfer belt 26, a driven roller 27, a drive roller 28, transfer rollers 29 and a cleaning blade 30. By the image forming section 4 and the transfer unit 5 configured as above, an image forming unit 13 for forming a developing agent image (toner image) on the medium P while conveying the medium P is formed.

One transfer roller 29 is provided corresponding to each of the development units 12K, 12C, 12M and 12Y and electrostatically transfers the toner image of each color formed by the corresponding development unit 12K, 12C, 12M, 12Y onto the medium P. A plurality of transfer rollers 29 are arranged to respectively face the photosensitive drums 14 of the development units 12K, 12C, 12M and 12Y via the transfer belt 26. Incidentally, the plurality of transfer rollers 29 have substantially the same configurations. Each of the transfer rollers 29 arranged to face the development units 12C, 12M and 12Y separates from the photosensitive drum 14 by a certain distance at times of monochrome printing.

The transfer belt 26 conveys the medium P conveyed thereto by the conveyance unit 3 towards the fixing unit 6. The transfer belt 26 is stretched by the drive roller 28 and the driven roller 27 and rotates counterclockwise in FIG. 1. Each of the drive roller 28 and the driven roller 27 conveys the transfer belt 26. The cleaning blade 30 scrapes off the toners adhering to the transfer belt 26.

[1-6. Configuration of Fixing Unit]

The fixing unit 6 applies heat and pressure to the toner image on the medium P conveyed from the transfer belt 26 and thereby fixes the toner image on the medium P. This fixing unit 6 includes, for example, a heating roller 46 and a pressure roller 48 arranged to face each other via the conveyance path through which the medium P is conveyed. The heating roller 46 includes a built-in heater. When the fixation process is executed, the pressure roller 48 is biased towards the heating roller 46 and forms a nip part.

[1-7. Configuration of Control Mechanism]

Figure 4:
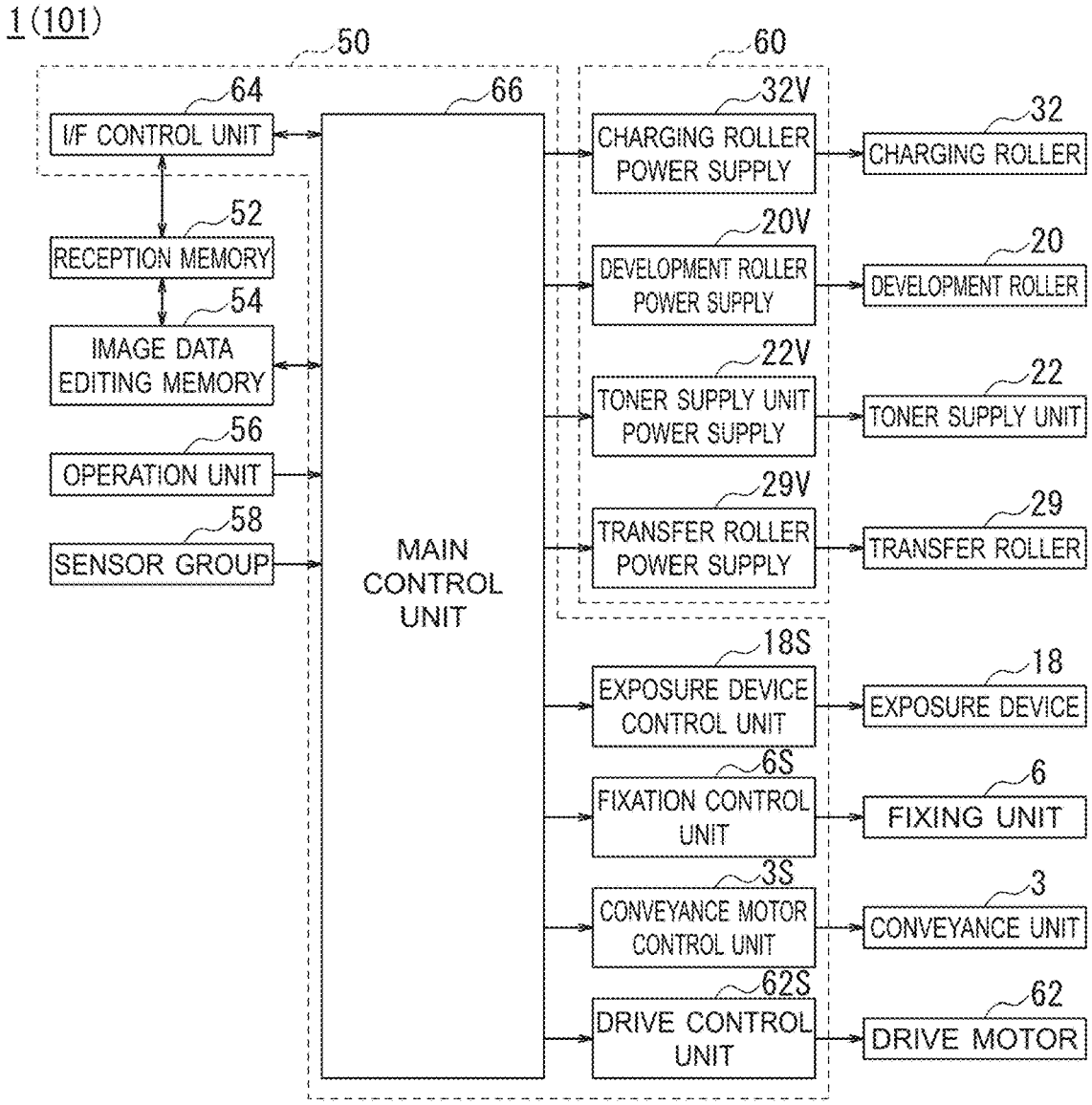
FIG. 4 is a block diagram showing a configuration of a control system of the image forming apparatus of FIG. 1.

Here, a control mechanism of the image forming apparatus 1 will be described with reference to FIG. 4. The image forming apparatus 1 includes a control section 50 as a controller, a reception memory 52, an image data editing memory 54, an operation unit 56, a sensor group 58 and a power supply circuit 60 as the control mechanism. This image forming apparatus 1 is further provided with a drive motor 62. The drive motor 62 drives the photosensitive drums 14 (FIG. 1).

The control section 50 includes an interface (I/F) control unit 64, a main control unit 66, an exposure device control unit 18S, a fixation control unit 6S, a conveyance motor control unit 3S and a drive control unit 62S. The main control unit 66 is formed with a microprocessor, a ROM (Read Only Memory), a RAM (Random Access Memory), input/output ports, and so forth, and controls the whole of a processing operation in the image forming apparatus 1 by executing a predetermined program, for example. Specifically, the main control unit 66 receives print data and control commands from the I/F control unit 64 and executes a print operation by performing centralized control of the exposure device control unit 18S, the fixation control unit 6S, the conveyance motor control unit 3S and the drive control unit 62S. The I/F control unit 64 receives the print data and the control commands from an external device such as a PC, or transmits a signal regarding the condition of the image forming apparatus 1.

The reception memory 52 temporarily stores the print data received from the external device such as a PC via the I/F control unit 64. The image data editing memory 54 receives the print data stored in the reception memory 52 and stores image data obtained by editing the print data. The operation unit 56 includes, for example, LED lamps for displaying information such as the condition of the image forming apparatus 1 and an input unit (buttons and/or a touch panel) for letting a user input commands to the image forming apparatus 1. The sensor group 58 includes various types of sensors for monitoring operating status of the image forming apparatus 1, such as a medium P position detection sensor, a temperature humidity sensor, a print density sensor and a toner remaining amount detection sensor, for example.

The exposure device control unit 18S sends the image data recorded in the image data editing memory 54 to the exposure device 18 while executing drive control of the exposure device 18. The fixation control unit 6S controls voltage applied to the fixing unit 6 when the toner image transferred onto the medium P is fixed on the medium P. The conveyance motor control unit 3S controls the operation of the conveyance unit 3 (the hopping roller 8 and the conveyance roller pairs 10 and 11) when the conveyance unit 3 conveys the medium P. The drive control unit 62S controls the operation of the drive motor 62.

The power supply circuit 60 includes a charging roller power supply 32V, a development roller power supply 20V, a toner supply unit power supply 22V and a transfer roller power supply 29V. Here, the charging roller power supply 32V, the development roller power supply 20V, the toner supply unit power supply 22V and the transfer roller power supply 29V respectively apply voltages based on commands from the main control unit 66 to the charging roller 32, the development roller 20, the toner supply unit 22 and the transfer roller 29. Voltage is applied to the development roller 20 by the development roller power supply 20V, by which the toner carried by the development roller 20 is developed on the electrostatic latent image formed on the surface of the photosensitive drum 14. Voltage is applied to the toner supply unit 22 by the toner supply unit power supply 22V, by which the toner is supplied from the toner supply unit 22 to the development roller 20. Voltage is applied to the charging roller 32 by the charging roller power supply 32V, by which the surface of the photosensitive drum 14 is charged. Voltage is applied to the transfer roller 29 by the transfer roller power supply 29V, by which the toner image developed on the surface of the photosensitive drum 14 is transferred onto the medium P.

[1-8. Operation of Image Forming Unit 13]

Next, the operation of the image forming unit 13 at the time of forming an image will be described below. The image forming unit in this embodiment includes at least a photosensitive drum 14, a charging device 16 and a development roller 20. With the rotation of the drive motor 62, the photosensitive drum 14, the development roller 20, the toner supply roller (not shown), the charging roller 32 and the cleaning roller 34 rotate in predetermined directions. In this embodiment, the external diameter of the photosensitive drum 14 is 24 [mm], the external diameter of the charging roller 32 is 9.5 [mm], and the external diameter of the cleaning roller 34 is approximately 5.9 [mm]. In this embodiment, the linear speed (circumferential speed) of the photosensitive drum 14 in the environment at normal temperature and humidity is set at 205.8 [mm/s], the linear speed of the charging roller 32 is set at 205.8 [mm/s], and the linear speed of the cleaning roller 34 is set at 184.3 [mm/s].

In the development unit 12, the toner supply roller (not shown) including a foam elastic layer as a sponge-like elastic body rotates while carrying the toner on its outer circumferential surface or in a cell, and arrives at a part for making contact with the development roller 20. Incidentally, DC voltage at −330 [V] is applied to the toner supply roller by a toner supply roller power supply (not shown). Further, DC voltage at −200 [V] is applied to the development roller 20 by the development roller power supply 20V. Then, the toner negatively charged due to a potential difference occurring between the development roller 20 and the toner supply roller is supplied to the development roller 20. The toner borne on the surface of the development roller 20 is formed into a thin layer by a development blade (not shown) to which DC voltage at −330 is applied by a development blade power supply (not shown). To the charging roller 32, DC voltage at −1000 is applied by the charging roller power supply 32V. Accordingly, the surface of the photosensitive drum 14 is charged uniformly. Then, the electrostatic latent image formed on the photosensitive drum 14 by the exposure by the exposure device 18 is supplied with the toner carried by the development roller 20, by which the electrostatic latent image is developed. The toner on the development roller 20 not supplied to the photosensitive drum 14 is scraped off by the toner supply roller at a facing part of the toner supply roller. The toner developed on the photosensitive drum 14 and not transferred onto the medium P and the external additive separating from the toner base particles and adhering to the surface of the photosensitive drum 14 are conveyed to a contacting part of the cleaning blade 24 and are scraped off.

[1-9. Method of Manufacturing Cleaning Roller]

Next, a method of manufacturing the cleaning roller 34 will be described below. Incidentally, FIG. 8A shows a transverse sectional view of the foam member 34*d* on which the foam member-side adhesive agent 34*c*2 has been stuck.

Figure 8A:
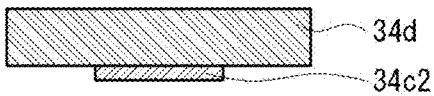
FIGS. 8A to 8D are diagrams showing a method of manufacturing the cleaning roller.
Figure 8B:
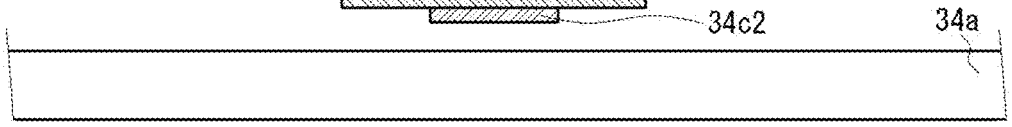
Figure 8C:
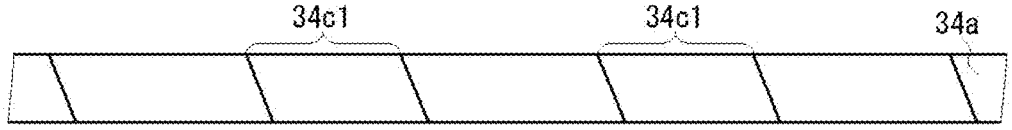
Figure 8D:
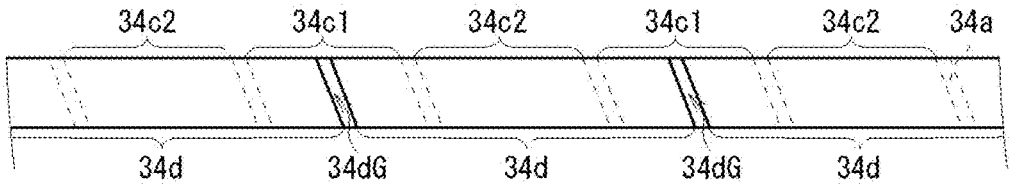

First, as shown in FIG. 8A, the foam member 34*d* as a belt-like elastic body, in which the foam member-side adhesive agent 34*c*2 as a belt-like second adhesive agent 3.5 [mm] wide has been stuck on a central part of one side of the belt-like foam member 34*d* 8.6 [mm] wide in regard to the short-side direction, is prepared previously. Subsequently, as a first step, around substantially the whole of the surface of the cleaning roller core bar 34*a* shown in FIG. 8B excluding two end parts, the core bar-side adhesive agent 34*c*1 as a belt-like first adhesive agent is helically wound while forming a gap (i.e., an interval) of 3.5 [mm] or more (e.g., 4.3 [mm]) as shown in FIG. 8C. This gap (i.e., a first gap) is formed between opposite sides of the belt-like first adhesive agent 34*c*1. Subsequently, as a second step, around substantially the whole of the surface of the cleaning roller core bar 34*a* excluding the two end parts, around which the belt-like core bar-side adhesive agent 34*c*1 has been wound helically, the foam member 34*d* on which the foam member-side adhesive agent 34*c*2 has been stuck is wound helically while forming the foam member gap 34*d*G as a 0.4 [mm] interval as shown in FIG. 8D.

Then, as a third step, the foam member-side adhesive agent 34*c*2 as the second adhesive agent is stuck on the gap between the core bar-side adhesive agents 34*c*1 adjoining each other in regard to the cleaning roller lengthwise direction on the surface of the cleaning roller core bar 34*a* so that the position of the central part of the foam member-side adhesive agent 34*c*2 in the short-side direction is registered with a central part of the gap between the adjoining core bar-side adhesive agents 34*c*1. Further, two end parts of the foam member 34*d* in the short-side direction are respectively stuck on a pair of core bar-side adhesive agents 34*c*1 arranged to adjoin each other in the cleaning roller lengthwise direction via the foam member-side adhesive agent 34*c*2.

By this process, the foam member 34*d* is fixed to the cleaning roller core bar 34*a* in the state in which the core bar-side adhesive agent 34*c*1 is provided continuously to extend from the inside of one foam member 34*d* regarding the width direction to the inside of the other foam member 34*d* regarding the width direction in regard to a pair of foam members 34*d* adjoining each other in the cleaning roller lengthwise direction via the foam member gap 34*d*G.

[1-10. About Occurrence of Black Dot]

Incidentally, the cleaning roller 34 provided with the elastic layer made of a foam material generally has a configuration in which a belt-like sheet formed with a foam material and an adhesive is helically wound around a core bar. This belt-like sheet is made by cutting a multilayer sheet formed by sticking a sheet of the adhesive such as double-stick tape on a sheet of the foam material. Thus, there are cases where chips of the adhesive adhere to cut surfaces of the belt-like sheet made by cutting the multilayer sheet.

Figure 9:
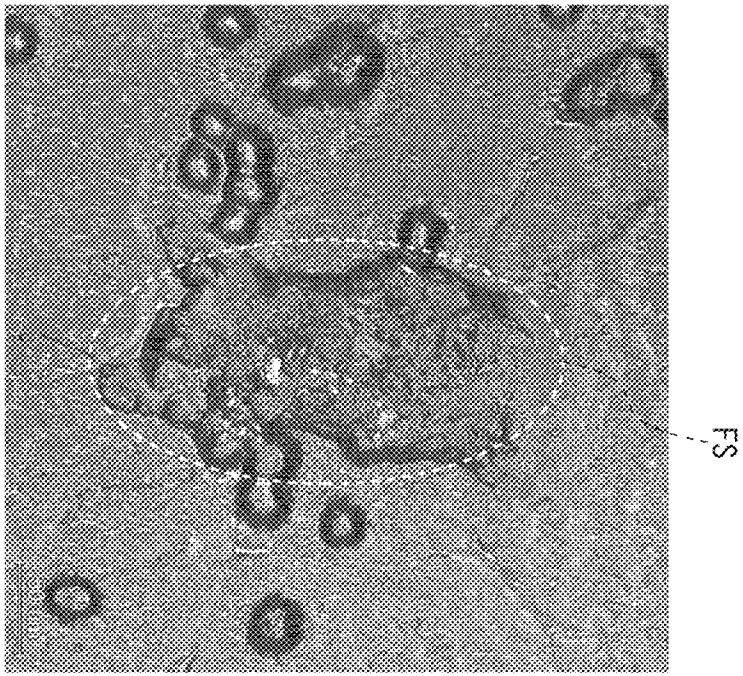
FIG. 9 is a diagram showing condition of a surface of a charging roller in a state in which a black dot has occurred.

If the cleaning roller 34 obtained by winding the belt-like sheet with the chips of the adhesive adhering to the cut surfaces is used in contact with the charging roller 32, a problem arises in that a chip FS of the adhesive adheres to the surface of the charging roller 32 as shown in FIG. 9 and an image defect at the cycle of the charging roller 32 occurs. This image defect at the cycle of the charging roller 32 is a "black dot" formed in a situation where the resistance value of the charging roller 32 rises in the part of the surface of the charging roller 32 to which the chip FS is adhering, the photosensitive drum 14 cannot be charged up to a desired electric potential, and the toner is developed in the part.

Here, downsizing of the image forming apparatus is an important development item in recent years, and the charging device including the charging roller and the cleaning roller is also being desired to be downsized. To reduce the diameter of the cleaning roller, the thickness of the elastic layer of the cleaning roller has to be decreased. However, with the decrease in the thickness of the elastic layer, the distance between the surface of the charging roller and the adhesive layer of the cleaning roller decreases, and thus the chips FS of the adhesive become more likely to make contact with the surface of the charging roller 32.

Further, while the gap between the photosensitive drum 14 and the charging roller 32 is required to be at a predetermined value or less for the electric discharge between the photosensitive drum 14 and the charging roller 32, the reduction in the diameters of the photosensitive drum 14 and the charging roller 32 narrows a range in the circumferential direction in which the gap is at the predetermined value or less. Furthermore, with the speeding up of the printing speed, the surface linear speed of the photosensitive drum 14 and the charging roller 32 also increases, and thus the time in which the surface of the photosensitive drum 14 and the surface of the charging roller 32 pass through the range in the circumferential direction in which the gap is at the predetermined value or less becomes shorter. To sum up, with the downsizing of the image forming apparatus 1, namely, with the reduction in the diameters of components, and with the speeding up of the printing speed, the defective charging of the surface of the photosensitive drum 14 due to foreign matter adhering to the surface of the charging roller 32 becomes more likely to occur.

Figure 10A:
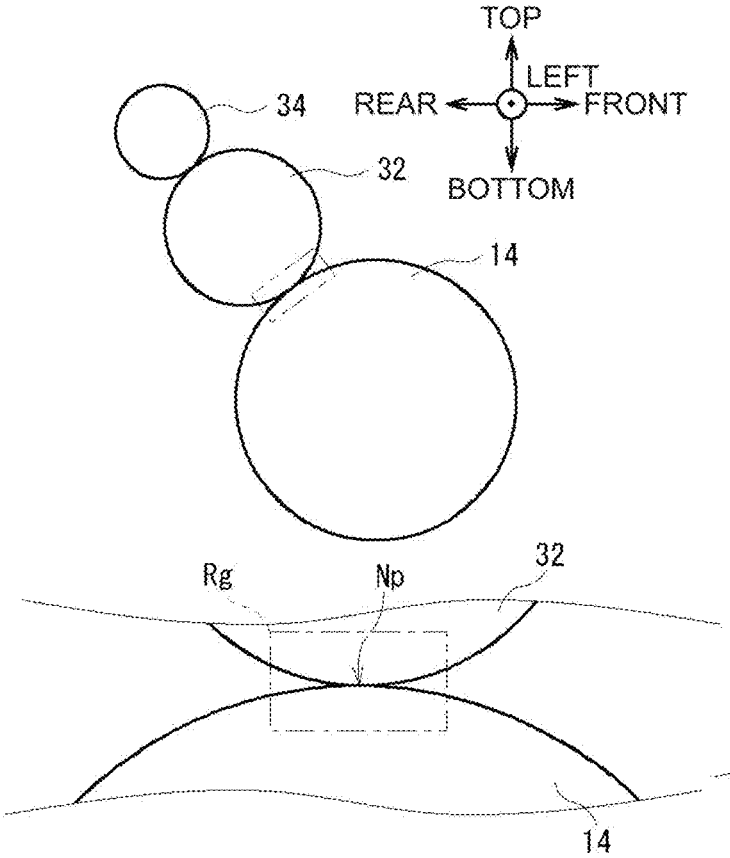
FIGS. 10A and 10B are diagrams showing cases where a photosensitive drum, the charging roller and the cleaning roller are large and small.

Specifically, when the external diameters of the photosensitive drum 14, the charging roller 32 and the cleaning roller 34 are large as shown in FIG. 10A, a dischargable range Rg as the range in the circumferential direction in which the gap between the photosensitive drum 14 and the charging roller 32 is at the predetermined value or less is wide. Thus, the image forming apparatus 1 is capable of charging the photosensitive drum 14 with the charging roller 32 across a relatively wide range around a nip part Np where the photosensitive drum 14 and the charging roller 32 contact each other, and thus is capable of charging the photosensitive drum 14 with the charging roller 32 for a long time. Accordingly, when the external diameters of the photosensitive drum 14, the charging roller 32 and the cleaning roller 34 are large, even if a chip FS of the adhesive agent 34*c* adheres to the charging roller 32 from the cleaning roller 34, the black dot is unlikely to occur thanks to the long charging time of the photosensitive drum 14.

Figure 10B:
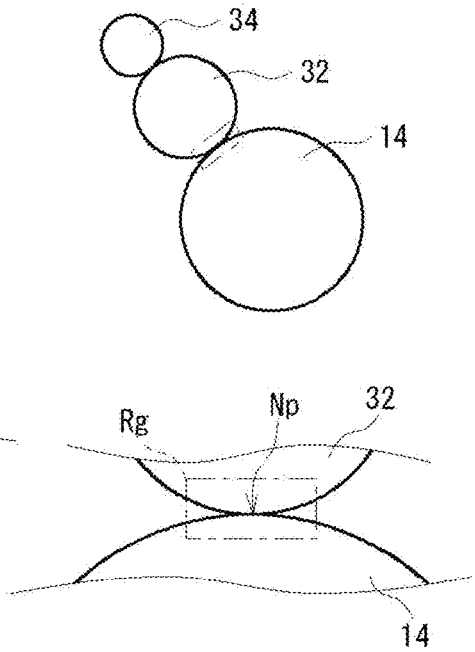

In contrast, when the external diameters of the photosensitive drum 14, the charging roller 32 and the cleaning roller 34 are small as shown in FIG. 10B, the dischargable range Rg becomes narrower. Thus, the image forming apparatus 1 is only capable of charging the photosensitive drum 14 with the charging roller 32 across a relatively narrow range around the nip part Np, and the time of charging the photosensitive drum 14 with the charging roller 32 becomes shorter. Further, if the printing speed is increased, the time of charging the photosensitive drum 14 with the charging roller 32 becomes still shorter. Accordingly, when the external diameters of the photosensitive drum 14, the charging roller 32 and the cleaning roller 34 are small, if a chip FS of the adhesive agent 34*c* adheres to the charging roller 32 from the cleaning roller 34, the black dot is likely to occur due to the short charging time of the photosensitive drum 14.

Figure 11:
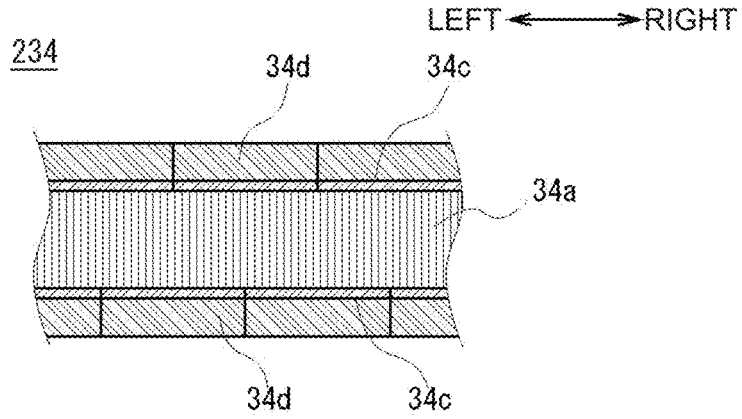
FIG. 11 is a cross-sectional view showing a configuration of a cleaning roller as a comparative example.

Here, an imaginary case where the foam member 34*d* is wound around the surface of the cleaning roller core bar 34*a* at narrower intervals in regard to the cleaning roller lengthwise direction as in a cleaning roller 234 shown in FIG. 11 will be discussed below.

In this case, as the foam member winding interval Gd is narrowed towards 0 [mm], the level of difficulty of the manufacture while preventing adjoining foam members 34*d* from overlapping with each other becomes higher and the productivity deteriorates. Further, if the foam member winding interval Gd is set too close to 0 [mm], adjoining foam members 34*d* can overlap with each other. When such an overlap of adjoining foam members 34*d* occurs, an appropriate nip cannot be obtained between the charging roller 32 and the cleaning roller 234 and a cleaning failure occurs. Accordingly, in order to secure mass productivity of the cleaning roller 234, it is necessary to design the interval between adjoining foam members 34*d* wide to a certain extent.

However, if the interval between adjoining foam members 34*d*, namely, the foam member gap 34*d*G, is widened, the possibility that a chip FS of the adhesive agent 34*c* comes out of the foam member gap 34*d*G to the outside of the foam member 34*d* becomes high. In that case, the chip FS adheres to the charging roller 32 from the cleaning roller 34 and the printing defect occurs.

Further, while there is also a manufacturing method in which the foam member 34*d* after being formed on the cleaning roller core bar 34*a* is abraded into a predetermined thickness, the abrasion into the thickness of the foam member 34*d* in this embodiment deteriorates the mass productivity.

[1-11. About Occurrence of Problem Depending on External Diameters of Photosensitive Drum and Cleaning Roller]

Here, a discussion will be given below on the extent of the downsizing of the external diameters of the photosensitive drum 14 and the cleaning roller 34 at which the present problem occurs.

Figure 12:
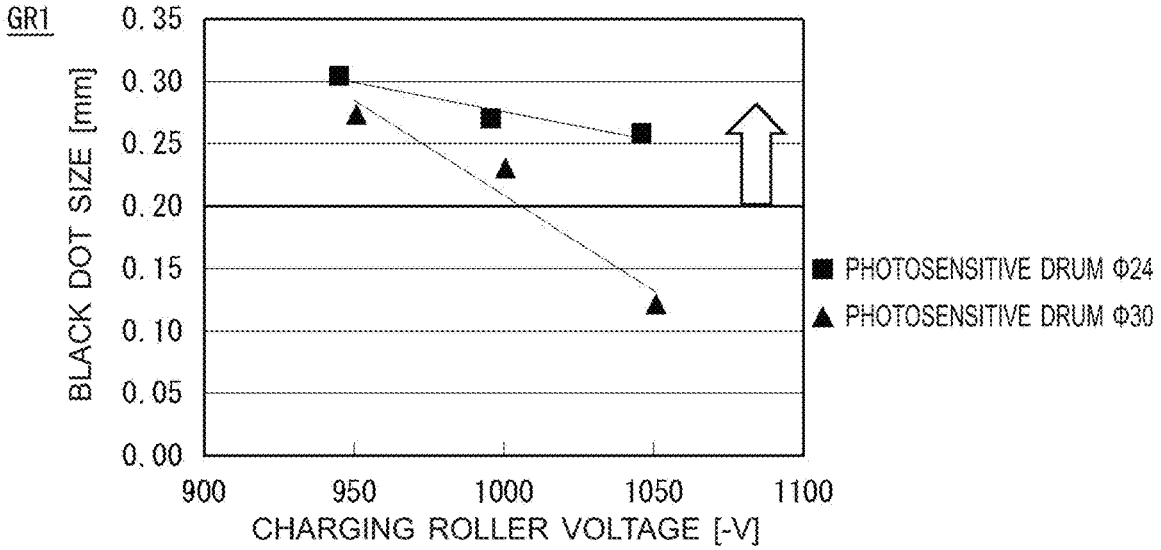
FIG. 12 is graph showing a relationship between a charging roller voltage and the size of the black dot.

First, by using two types of photosensitive drums 14 having external diameters of ϕ24 [mm] and ϕ30 [mm] while leaving the charging roller 32 and the cleaning roller 34 at the common sizes, the adhesive agent 34*c* approximately 0.3 [mm] is stuck on the charging roller 32 and a comparison is made of the size of the black dot in the print image on the medium P while changing the charging roller voltage. The result of the observation is shown in graph GR1 in FIG. 12.

As shown in graph GR1, with the increase in the absolute value of the charging roller voltage, the size of the black dot showed a tendency to decrease since the surface of the photosensitive drum 14 becomes more likely to be charged sufficiently. Further, the gradient of the decrease in the black dot size with respect to the charging roller voltage is greater with the larger external diameter of the photosensitive drum 14. Namely, the black dot became less conspicuous with the larger external diameter of the photosensitive drum 14.

Here, while the black dot is not visually recognized when the black dot appearing on the medium P is smaller than 0.20 [mm], the black dot becomes visually recognizable when the black dot appearing on the medium P is 0.20 [mm] or larger. According to graph GR1, with the decrease in the external diameter of the photosensitive drum 14, the black dot becomes larger and thus the black dot as the present problem becomes more likely to be visually recognized. Namely, in the case of ϕ30 [mm] as the external diameter of the conventional photosensitive drum 14, the occurrence of the black dot, as the problem itself, is unlikely to be recognized even though that depends on the charging roller voltage. Thus, it can be understood that the occurrence of the black dot is a problem specific to the downsizing of the development unit 12.

Further, since the charging roller 32 and the cleaning roller 34 are originally and conventionally smaller in the external diameter than the photosensitive drum 14, further reducing their external diameters has only little influence on the black dot. In contrast, the photosensitive drum 14 is larger in the external diameter than the charging roller 32 and the cleaning roller 34, and thus the change from ϕ30 [mm] as the external diameter of the conventional photosensitive drum 14 to ϕ24 [mm] has great influence on the black dot.

Figure 13:
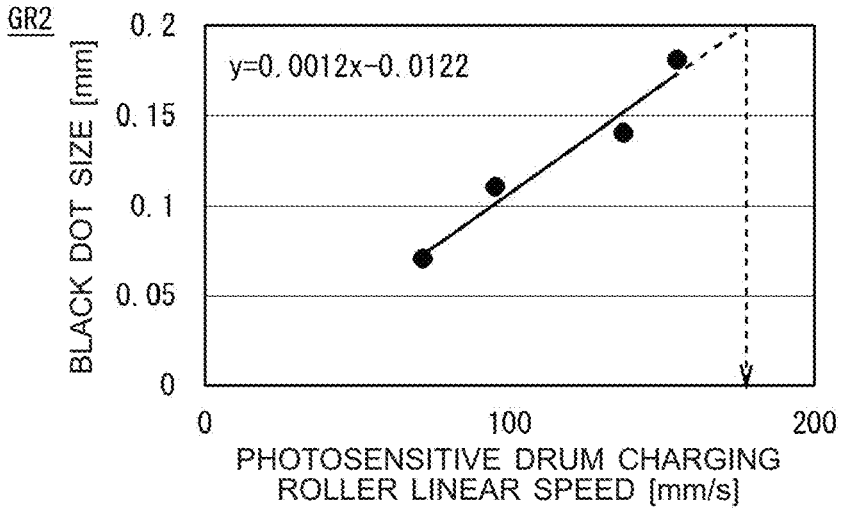
FIG. 13 is graph showing a relationship between a linear speed of the photosensitive drum and the charging roller and the size of the black dot.

Subsequently, by using the photosensitive drum 14 having the external diameter of ϕ24 [mm], the size of the black dot in the print image on the medium P is observed while changing the linear speed (circumferential speed) of the photosensitive drum 14 and the charging roller 32. The result of the observation is shown in graph GR2 in FIG. 13. As shown in graph GR2, with the decrease in the linear speed of the photosensitive drum 14 and the charging roller 32, the size of the black dot showed a tendency to decrease since the surface of the photosensitive drum 14 becomes more likely to be charged sufficiently. An approximation formula of this graph GR2 is obtained as $y=0.0012x-0.0122$.

As mentioned earlier, the black dot becomes visually recognizable when the black dot appearing on the medium P is 0.20 [mm] or larger. Therefore, the upper limit of the linear speed of the photosensitive drum 14 in cases where the black dot appears is obtained here. Substituting $y=0.20$ into the approximation formula $y=0.0012x-0.0122$ leads to $0.20=0.0012x-0.0122$, and this is transformed into $0.0012x=-0.2122$ by transposition. From this equation, x is obtained as $x\approx176.8$ [mm/s]. This is the linear speed of the photosensitive drum 14 in a low temperature low humidity environment in which the printing speed slows down. As above, the black dot appearing on the medium P becomes visually recognizable when the linear speed (circumferential speed) of the photosensitive drum 14 and the charging roller 32 is faster than 176.8 [mm/s].

[1-12. Effect and Other Features]

In the charging device 16 configured as above, the core bar-side adhesive agent 34*c*1 is provided continuously to extend from the inside of one foam member 34*d* regarding the width direction to the inside of the other foam member 34*d* regarding the width direction in regard to a pair of foam members 34*d* adjoining each other in the cleaning roller lengthwise direction via the foam member gap 34*d*G. Therefore, the charging device 16 is capable of preventing both ends of the core bar-side adhesive agent 34*c*1 in the cleaning roller lengthwise direction (i.e., both long sides of the core bar-side adhesive agent 34*c*1) from being exposed to the outside of the foam member 34*d* by covering the both ends with the foam member 34*d*.

Accordingly, the charging device 16 is capable of preventing the chip FS of the core bar-side adhesive agent 34*c*1 from moving from the foam member gap 34*d*G to the outside of the foam member 34*d* and preventing the chip FS from being exposed on the surface of the foam member 34*d*. As above, the charging device 16 is capable of inhibiting the chip FS of the core bar-side adhesive agent 34*c*1 from adhering to the charging roller 32, inhibiting the occurrence of the black dot, and inhibiting the occurrence of the printing defect.

Further, the charging device 16 is configured so that both of the first direction end and the opposite direction end of the foam member-side adhesive agent 34*c*2 as the second adhesive agent in the cleaning roller lengthwise direction are situated inside the foam member 34*d* in regard to the width direction. Therefore, the charging device 16 is capable of preventing both ends of the foam member-side adhesive agent 34*c*2 in the cleaning roller lengthwise direction (i.e., both long sides of the foam member-side adhesive agent 34*c*2) from being exposed to the outside of the foam member 34*d* by covering the both ends with the foam member 34*d*.

Accordingly, the charging device 16 is capable of preventing the chip FS of the foam member-side adhesive agent 34*c*2 from moving from the foam member gap 34*d*G to the outside of the foam member 34*d* and preventing the chip FS from being exposed on the surface of the foam member 34*d*. As above, the charging device 16 is capable of inhibiting the chip FS of the foam member-side adhesive agent 34*c*2 from adhering to the charging roller 32, inhibiting the occurrence of the black dot, and inhibiting the occurrence of the printing defect.

In the manufacture of the cleaning roller 34, there is a possibility that a worker winds the foam member 34*d*, without the foam member-side adhesive agent 34*c*2 stuck thereon, around the cleaning roller core bar 34*a*. In that case, however, if the worker winds the foam member 34*d* around the cleaning roller core bar 34*a* while pulling the foam member 34*d* and applying tension in the lengthwise direction of the foam member 34*d*, the foam member 34*d* stretches and deforms since the foam member 34*d* is a form material like a sponge. Further, since the foam member 34*d* is soft, it is difficult to maintain high positional accuracy when winding the foam member 34*d* around the cleaning roller core bar 34*a*.

In contrast, the cleaning roller 34 according to this embodiment is configured so that the foam member 34*d* with the foam member-side adhesive agent 34*c*2 previously stuck thereon is wound around the cleaning roller core bar 34*a* by the worker. Thus, thanks to the foam member-side adhesive agent 34*c*2 that is more likely to maintain shape and harder than the foam member 34*d*, the cleaning roller 34 is capable of letting the worker wind the foam member 34*d* around the cleaning roller core bar 34*a* while avoiding the deformation of the foam member 34*d* and maintaining the shape of the foam member 34*d* and capable of facilitating the worker to maintain high positional accuracy when winding the foam member 34*d* around the cleaning roller core bar 34*a*. Accordingly, the cleaning roller 34 is capable of lowering the manufacture difficulty level at the time of manufacturing the cleaning roller 34.

According to the above-described configuration, the charging device 16 includes the charging roller 32 that is rotatable and contacts and electrically charges the surface of the photosensitive drum 14 as the charging target member and the cleaning roller 34 that is rotatable and cleans the surface of the charging roller 32, wherein the cleaning roller 34 includes the cleaning roller core bar 34*a* extending in the transverse direction as the cleaning roller lengthwise direction, the foam member 34*d* that is helically wound around the cleaning roller core bar 34*a* while forming the foam member gap 34*d*G and contacts the charging roller 32, and the first adhesive agent that is provided between the foam member 34*d* and the cleaning roller core bar 34*a* and contacts a pair of foam members 34*d* (i.e., a part of the foam member 34*d* and another part of the foam member 34*d*) formed to adjoin each other in the cleaning roller lengthwise direction via the foam member gap 34*d*G.

With this configuration, the charging device 16 is capable of covering both ends of the core bar-side adhesive agent 34*c*1 in the cleaning roller lengthwise direction with the foam member 34*d* and thereby preventing the both ends from being exposed to the outside of the foam member 34*d* and preventing the chip FS as foreign matter from the core bar-side adhesive agent 34*c*1 from being exposed on the surface of the foam member 34*d*. As above, the charging device 16 is capable of inhibiting the chip FS of the cleaning roller 34 from adhering to the charging roller 32, inhibiting the occurrence of the printing defect, and maintaining high print quality.

2. Second Embodiment

[2-1. Configuration of Image Forming Apparatus]

An image forming apparatus 101 (FIG. 1) according to a second embodiment differs from the image forming apparatus 1 according to the first embodiment in including a charging device 116 replacing the charging device 16, but is configured in the same way in regard to the other features.

[2-2. Configuration of Charging Device]

As shown in FIG. 2, the charging device 116 differs from the charging device 16 according to the first embodiment in including a cleaning roller 134 replacing the cleaning roller 34, but is configured in the same way in regard to the other features.

[2-3. Configuration of Cleaning Roller]

Figure 14:
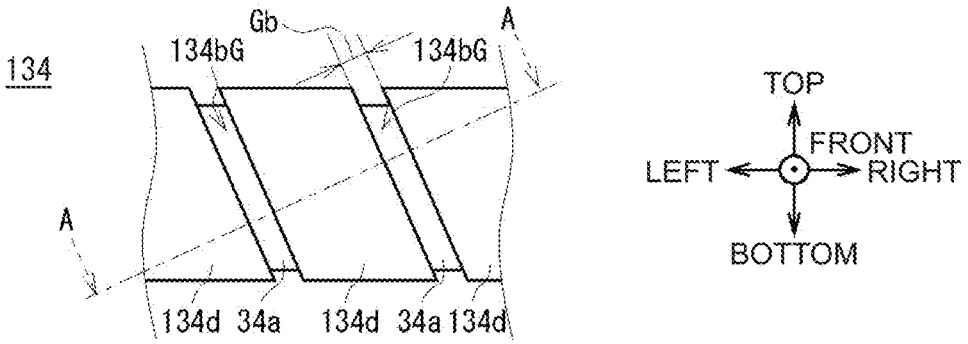
FIG. 14 is an enlarged front view showing a configuration (1) of a cleaning roller according to a second embodiment.
Figure 15:
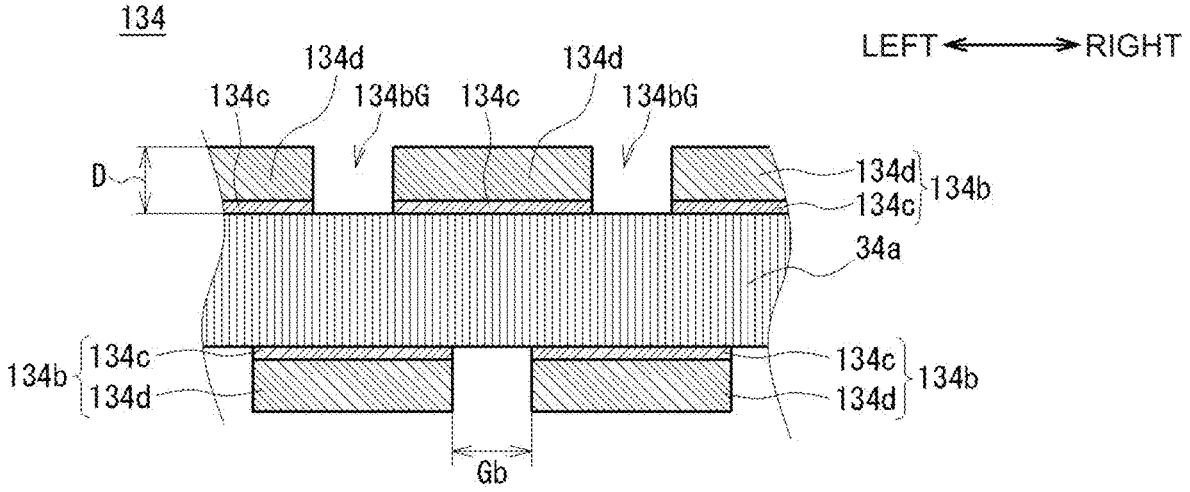
FIG. 15 is a cross-sectional view taken in an arrow direction of the line A-A in FIG. 14 and showing a configuration (2) of the cleaning roller according to the second embodiment.

The cleaning roller 134 (FIG. 5) differs from the cleaning roller 34 according to the first embodiment in including a cleaning roller elastic layer 134*b* replacing the cleaning roller elastic layer 34*b*, but is configured in the same way in regard to the other features. As shown in FIG. 14 in which members corresponding to those in FIG. 6 are assigned the same reference characters as in FIG. 6 and FIG. 15 in which members corresponding to those in FIG. 7 are assigned the same reference characters as in FIG. 7, the cleaning roller elastic layer 134*b* differs from the cleaning roller elastic layer 34*b* according to the first embodiment in including a foam member 134*d* and an adhesive agent 134*c* replacing the foam member 34*d* and the adhesive agent 34*c*, but is configured in the same way in regard to the other features.

The foam member 134*d* and the cleaning roller core bar 34*a* are bonded together by the adhesive agent 134*c*. The adhesive agent 134*c* is the same material as the core bar-side adhesive agent 34*c*1 and the foam member-side adhesive agent 34*c*2 according to the first embodiment. The cleaning roller elastic layer 134*b* is made by sticking the adhesive agent 134*c* as double-stick tape with the same width as the foam member 134*d* on the back surface of the foam member 134*d* as a urethane foam material 8.5 [mm] wide, and is helically wound around the cleaning roller core bar 34*a* while setting an elastic layer winding interval Gb of an elastic layer gap 134*b*G at 0.5 [mm] or less.

The cleaning roller elastic layer 134*b* is made by punching out a multilayer sheet as a stack of a form material sheet and an adhesive sheet into a sheet having a desired width by using a Thomson die. When the cleaning roller elastic layer 134*b* as a belt-like elastic body is made by such a method, the blade of the Thomson die moves through the multilayer sheet of the foam material and the adhesive in a cross-sectional direction (thickness direction), and thus chips FS of the adhesive generated due to the movement of the blade can adhere to the cut surfaces of the cleaning roller elastic layer 134*b*.

Here, the thickness (wall thickness) of the cleaning roller elastic layer 134*b* including the thickness (0.145 [mm]) of the adhesive agent 134*c* is defined as an elastic layer thickness D [mm]. In this embodiment, the elastic layer thickness D is set at 0.95 [mm], for example.

Figure 16:
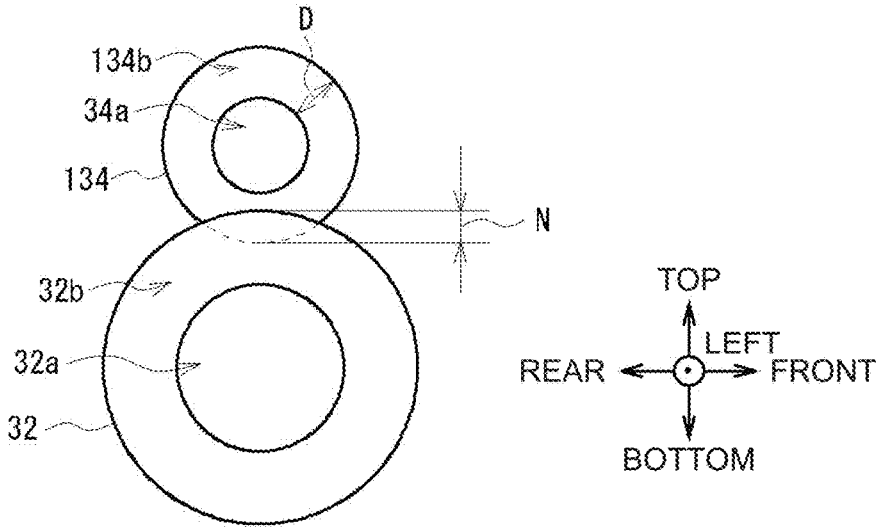
FIG. 16 is a left side view showing a nip level.

In such a configuration, while the external additive that passed by the cleaning blade 30 adheres to the surface of the charging roller 32, the charging device 116 is capable of scraping off the external additive by making the cleaning roller 134 contact the charging roller 32 at an appropriate nip level. In this embodiment, the cleaning roller 134 is biased towards the charging roller 32 so that the nip level N of the charging roller 32 and the cleaning roller 134 shown in FIG. 16 is 0.4 to 0.5 [mm].

In regard to the nip level N, the degree of nipping the charging roller 32 by the cleaning roller 134 is measured by using a noncontact three-dimensional measurement device NH-5Ns (manufactured by Mitaka Kohki Co., Ltd., objective lens: ×50). Specifically, in this measurement, an inter-axial distance between the central axis of the charging roller 32 and the central axis of the cleaning roller 134 is measured by determining the central axis of the charging roller core bar 32*a* in the charging roller 32 and the central axis of the cleaning roller core bar 34*a* in the cleaning roller 134 from arc shapes of the outer circumferences of the charging roller 32 and the cleaning roller 134 corresponding to a rotation angle of 30 degrees, and the nip level N of the cleaning roller 134 is calculated by regarding the decrement in the inter-axial distance as being equivalent to a depression level of the cleaning roller 134 shown in FIG. 16, namely, the nip level N.

In this case, since the hardness of the charging roller elastic layer 32*b* of the charging roller 32 is sufficiently higher than that of the cleaning roller elastic layer 134*b* of the cleaning roller 134, only the cleaning roller 134 is considered to have become depressed, and the depression level of the charging roller elastic layer 32*b* of the charging roller 32 is neglected.

[2-4. Evaluation of Cleaning Roller]

Evaluation of the cleaning roller 134 is made by using the image forming apparatus 101 and the charging device 116 configured as above. In this evaluation, 20 types of cleaning rollers 134 as examples 1 to 20 and 9 types of cleaning rollers 134 as comparative examples 1 to 9 are made according to combinations of various elastic layer thicknesses D and elastic layer winding intervals Gb as shown in table TB1 in FIG. 18 and table TB2 in FIG. 19 and evaluation is made in regard to whether the black dot occurred or not. Incidentally, the elastic layer winding interval Gb is a numerical value obtained by observing the elastic layer gap 134*b*G with a CCD (Charge Coupled Device) camera at a magnification of 80 times and measuring the interval in the same direction as the foam member winding interval Gd in the first embodiment.

In this evaluation, evaluation of the print image is made. In the evaluation of the print image, the presence or absence of occurrence of the black dot (color dot) at the cycle of the charging roller 32 is evaluated and the result of the evaluation is shown in table TB1 in FIG. 18 and table TB2 in FIG. 19. The method of the print test is as described below. In table TB1 and table TB2, the presence or absence of occurrence of the black dot (color dot) is described as "non-occurrence" when no black dot occurred and described as "occurrence" when a black dot occurred.

- continuous printing at 1% duty (print image density) and 3 pages/job
- printing on 10000 sheets in environment of 23 [° C.] temperature and 55 [% RH] humidity
- thereafter printing on 10000 sheets in environment of 28 [° C.] temperature and 80 [% RH] humidity
- thereafter printing on 10000 sheets in environment of 10 [° C.] temperature and 20 [% RH] humidity
- printing on 30000 sheets in total
- after the continuous printing, checking image quality in environment of 10 [° C.] temperature and 20 [% RH] humidity
- image check pattern: white paper (0% duty (print image density))

Here, the print image density is a value representing the ratio between the number of pixels where the developing agent is transferred onto the medium P and the total number of pixels when the image is divided in units of pixels. For example, 100% area ratio printing in cases of performing full-page solid color printing on a printable range in a predetermined region (corresponding to one cycle of the photosensitive drum 14, one page of the print medium or the like) is described as 100% print image density, and printing corresponding to an area that is 1% of the 100% print image density is described as 1% print image density. By representing the print image density DPD as a numerical expression by using a used dot count Cm, a rotation count Cd and a total dot count CO, the print image density DPD can be represented as the following expression (1):

$$DPD[\%]=Cm/(Cd\times CO)\times 100 \quad (1).$$

Incidentally, the used dot count Cm is the number of dots actually used for forming the image while the photosensitive drum 14 rotates Cd times, that is, the total number of dots exposed by the exposure device 18 while the image is formed. The total dot count CO is the total number of dots per rotation of the photosensitive drum 14, that is, the total number of dots potentially usable when forming the image irrespective of the presence or absence of the exposure in one rotation of the photosensitive drum 14. In other words, the total dot count CO is the total number of dots used in the formation of a solid color image (solid image) performed by transferring the developing agent onto all the pixels. Therefore, the value (Cd×CO) indicates the total number of dots potentially usable when forming the image while the photosensitive drum 14 rotates Cd times.

[2-5. Relationship Between Elastic Layer Thickness and Elastic Layer Winding Interval]

The elastic layer thicknesses D and the elastic layer winding intervals Gb in the cleaning rollers 134 used for the evaluation are shown in graph GR3 in FIG. 20 having a horizontal axis representing the elastic layer thickness D and a vertical axis representing the elastic layer winding interval Gb (i.e., a bonding interval G). Drawing an approximation straight line in graph GR3 clearly indicates that occurrences and non-occurrences of the black dot are distributed separately from each other via the following approximation formula (2):

$$Gb=0.578\times D-0.316 \quad (2).$$

Incidentally, in cases where the elastic layer thickness D is greater than 1.050 [mm], the thick elastic layer is retrogressive to the downsizing of the charging device 116, i.e., the reduction in the diameter of the cleaning roller 134, and leaving the cleaning roller 134 as it is for a long period has a risk that the cleaning roller elastic layer 134*b* becomes depressed to cause a nip mark and deterioration in the cleanability, and thus the evaluation is made as NG (no good). In contrast, in cases where the elastic layer thickness D is less than 0.875 [mm], the cleaning roller elastic layer 34*b* arranged between the cleaning roller core bar 34*a* and the charging roller 32 being hard materials thinned down, the hardness of the cleaning roller 134 increased as a result, and that lead to deterioration in the durability of the charging roller 32, and thus the evaluation is made as NG (no good). The deterioration in the durability of the charging roller 32 mentioned here means the surface of the charging roller 32 being scarred, the falling off of particles provided on the charging roller elastic layer 32*b* in order to form roughness, and so forth.

The result of observing the surface of the charging roller 32 in the state in which the black dot occurred on the medium P is shown in FIG. 9. It is confirmed that a chip FS of the adhesive agent 134*c* of the cleaning roller 134 approximately 0.2 [mm] in size is adhering to the surface of the charging roller 32.

Further, the black dot did not occur when the elastic layer winding interval Gb and the elastic layer thickness D satisfied a relationship of the following expression (3): The reason for this result will be discussed below.

$$Gb\leq 0.578\times D-0.316 \quad (3).$$

Figure 21:
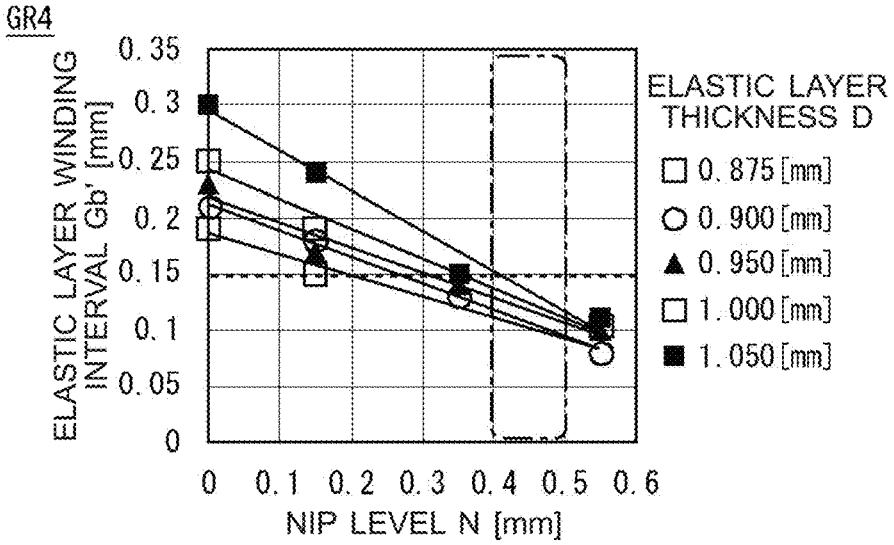
FIG. 21 is a graph showing a relationship between the nip level and an elastic layer winding interval.

Graph GR4 in FIG. 21 is a graph showing the relationship between the nip level N of the cleaning roller 134 and the elastic layer winding interval Gb' at the time of nipping in the example 3, the example 6, the example 11, the example 15 and the example 20.

Figure 17A:
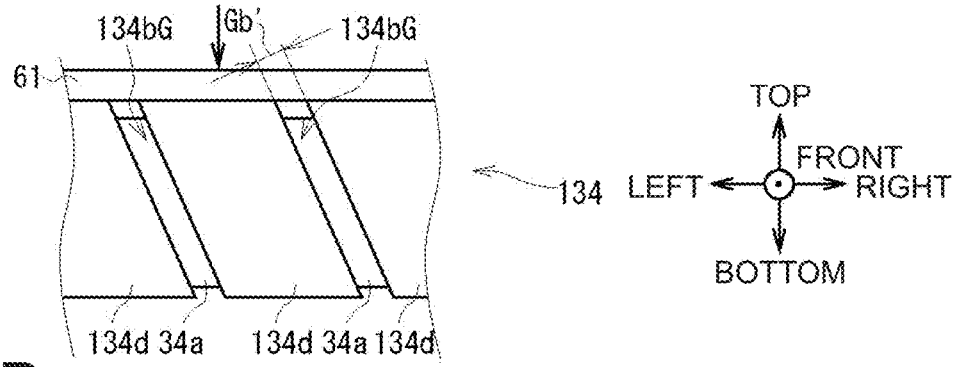
FIGS. 17A and 17B are diagrams showing a method of measuring an elastic layer winding interval at a time of nipping.
Figure 17B:
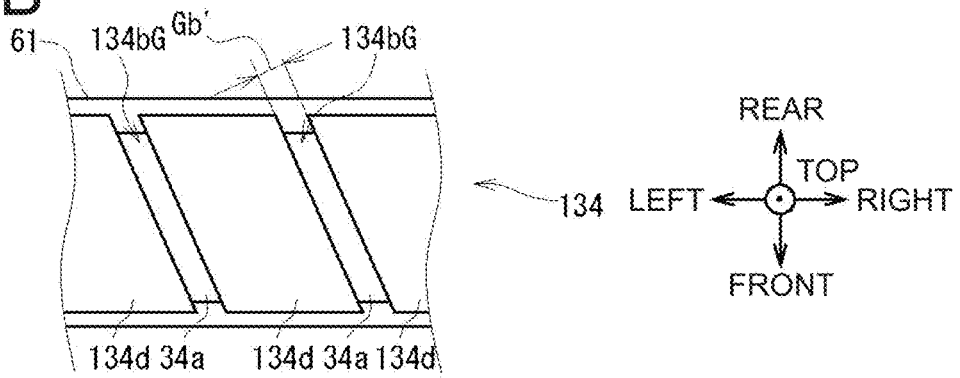

The method of measuring the elastic layer winding interval Gb' at the time of nipping will be described below by using FIGS. 17A and 17B. A glass slide 61 is placed on the cleaning roller 134 and is pressed in the direction of the arrow in FIG. 17A (downward direction) for a distance corresponding to the nip level. FIG. 17B is a diagram showing the structure in FIG. 17A as viewed in the direction of the arrow. In the state in which the glass slide 61 has been pressed down, the elastic layer winding interval Gb' is measured by the same method as the elastic layer winding interval Gb.

In the example 3, the example 6, the example 11, the example 15 and the example 20 corresponding to the upper limit of the black dot non-occurrence region, the elastic layer winding interval Gb' when the nip level N is in the range of 0.4 to 0.5 [mm] which is set in this embodiment is less than or equal to 0.15 [mm].

Figure 22:
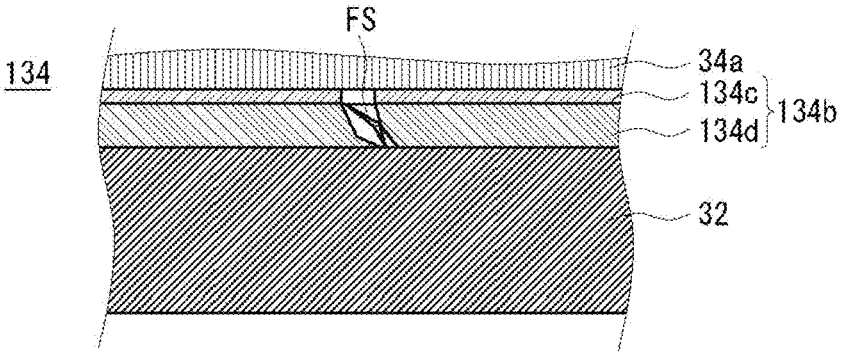
FIG. 22 is a cross-sectional view taken in the arrow direction of the line A-A in FIG. 14 and showing the cleaning roller in a case where the elastic layer winding interval is small.
Figure 23:
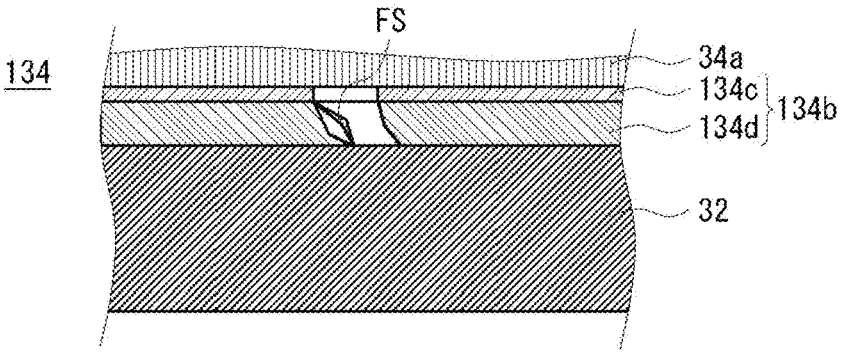
FIG. 23 is a cross-sectional view taken in the arrow direction of the line A-A in FIG. 14 and showing the cleaning roller in a case where the elastic layer winding interval is large.

Since the size of the adhesive agent 134*c* adhering to the charging roller 32 is approximately 0.15 to 0.20 [mm] in the comparative example 1 to the comparative example 9, it can be considered that the black dot did not occur in the example 1 to the example 20 since the chip FS of the adhesive agent 134*c* adhering to a cut surface of the cleaning roller elastic layer 134*b* is successfully sandwiched between adjoining foam materials at the cleaning roller elastic layer 134*b*'s gap less than or equal to 0.15 [mm] as shown in FIG. 22. In contrast, in the comparative example 1 to the comparative example 9, it can be considered that the black dot occurred since the chip FS of the adhesive agent 134*c* adhering to a cut surface of the cleaning roller elastic layer 134*b* is not successfully sandwiched between adjoining foam materials at the cleaning roller elastic layer 134*b*'s gap wider than 0.15 [mm] as shown in FIG. 23.

Further, the black dot occurred in cases in the region above the approximation formula Gb=0.578×D−0.316, that is, in the region of Gb>0.578×D−0.316. This can be understood as follows: With the decrease in the elastic layer thickness D, the amount of deformation of the cleaning roller elastic layer 134*b* in a direction of filling in the elastic layer gap 134*b*G (cleaning roller lengthwise direction) caused by the nip pressure decreases, and thus the elastic layer thickness D needs to be a certain thickness or more when the elastic layer winding interval Gb is great.

In contrast, in cases where Gb≤0.578×D−0.316 is satisfied, the elastic layer thickness D has a sufficient value corresponding to the elastic layer winding interval Gb, and thus it can be considered that the black dot did not occur since the chip FS of the adhesive agent 134*c* adhering to a cut surface of the cleaning roller elastic layer 134*b* is successfully sandwiched between adjoining foam materials at the elastic layer gap 134*b*G when the cleaning roller elastic layer 134*b* is deformed by the nip pressure applied thereto.

[2-6. Effect and Other Features]

In the charging device 116 configured as above, the cleaning roller 134 made by winding a belt-like elastic body, obtained by stacking the cleaning roller elastic layer 134*b* as a belt-like foam material and the adhesive agent 134*c* as a belt-like adhesive the same as each other in width, around the outer circumference of the cleaning roller core bar 34*a* like a helix or a helical shape is configured so that the elastic layer thickness D [mm] as the thickness of the cleaning roller elastic layer 134*b* and the adhesive agent 134*c* and the elastic layer winding interval Gb [mm] as the interval of the cleaning roller elastic layer 134*b* as the belt-like elastic body wound around the cleaning roller core bar 34*a* satisfy:

$$0.875 \leq D \leq 1.05 \text{ and } Gb \leq 0.578 \times D - 0.316.$$

Accordingly, the charging device 116 is capable of preventing a chip FS adhering to a cut surface of the cleaning roller elastic layer 134*b* and the adhesive agent 134*c* as the belt-like elastic body of the cleaning roller 134 from moving from the elastic layer gap 134*b*G to the outside of the cleaning roller elastic layer 134*b* and preventing the chip FS from being exposed on the surface of the cleaning roller elastic layer 134*b*. As above, the charging device 116 is capable of inhibiting the chip FS from adhering to the charging roller 32, inhibiting the occurrence of the black dot, and inhibiting the occurrence of the printing defect.

Further, the charging device 116 is configured so that the elastic layer thickness D satisfies D≥0.875 [mm]. With this setting, the charging device 116 is capable of preventing the hardness of the cleaning roller 134 from being too high and preventing the deterioration in the durability of the charging roller 32. Furthermore, the charging device 116 is configured so that the elastic layer thickness D satisfies D≤1.050 [mm]. With this setting, the charging device 116 is capable of preventing the cleaning roller elastic layer 134*b* from being too thick, downsizing the charging device 116, and maintaining high cleanability by preventing the occurrence of a nip mark on the cleaning roller elastic layer 134*b* when the cleaning roller 134 is left as it is for a long period.

According to the above-described configuration, the charging device 16 includes the charging roller 32 that is rotatable and contacts and electrically charges the surface of the photosensitive drum 14 as the charging target member and the cleaning roller 34 that is rotatable and cleans the surface of the charging roller 32, wherein the cleaning roller 134 is formed by bonding the cleaning roller elastic layer 134*b* as a strip-like elastic member to the cleaning roller core bar 34*a* as a core bar, and the elastic layer thickness D [mm] as the thickness of the cleaning roller elastic layer 134*b* as the elastic member and the elastic layer winding interval Gb [mm] as a bonding interval of the cleaning roller elastic layer 134*b* satisfy:

$$Gb \leq 0.578 \times D - 0.316.$$

With this configuration, the charging device 116 is capable of sandwiching the chip FS as foreign matter from the adhesive agent 134*c* between adjoining foam members 134*d* at the elastic layer gap 134*b*G and preventing the chip FS from being exposed on the surface of the cleaning roller elastic layer 134*b*. As above, the charging device 116 is capable of inhibiting the chip FS of the cleaning roller 134 from adhering to the charging roller 32, inhibiting the occurrence of the printing defect, and maintaining high print quality.

In addition, the charging device 116 according to the second embodiment can achieve the same functions and advantages as the charging device 16 according to the first embodiment.

3. Other Embodiments

In the above-described second embodiment, a description is given of a case where the cleaning roller 134 satisfies both of "0.875≤elastic layer thickness D≤1.05" as a first condition and "elastic layer winding interval Gb≤0.578× elastic layer thickness D−0.316" as a second condition. Embodiments are not limited to this case; the cleaning roller 134 is only required to satisfy at least the second condition.

In the above-described first embodiment, a description is given of a case where the foam member 34*d* is bonded to the cleaning roller core bar 34*a* by using both the core bar-side adhesive agent 34*c*1 and the foam member-side adhesive agent 34*c*2. Embodiments are not limited to this case; it is also possible to leave out the foam member-side adhesive agent 34*c*2 and bond the foam member 34*d* to the cleaning roller core bar 34*a* by using the core bar-side adhesive agent 34*c*1 alone as long as the foam member 34*d* can be wound around the cleaning roller core bar 34*a* exactly according to the design in the manufacture of the cleaning roller 34.

Further, the dimensions and the like in the above-described first embodiment may be set at various other values. However, setting the width of the core bar-side adhesive agent 34*c*1 as wide as possible and arranging the ends of the core bar-side adhesive agent 34*c*1 as inside the foam member 34*d* as possible in the width direction of the foam member 34*d* is more effective for preventing the ends of the core bar-side adhesive agent 34*c*1 from being exposed to the outside of the foam member 34*d*.

In the above-described first embodiment, a description is given of a case where the cleaning roller elastic layer 34*b* is helically wound around the surface of the cleaning roller core bar 34*a* while forming intervals in the lengthwise direction. Embodiments are not limited to this case; it is also possible, for example, to bond a plurality of belt-like cleaning roller elastic layers 34*b* to the surface of the cleaning roller core bar 34*a* in the lengthwise direction while forming intervals in the circumferential direction. In short, it is permissible if the function as the cleaning roller 34 can be achieved by configuring the cleaning roller elastic layer 34*b* to be able to clean the surface of the charging roller 32. The same goes for the second embodiment.

In the above-described embodiments, descriptions are given of cases where the cleaning roller 34 or 134 and the charging roller 32 perform circular movement, namely, rotate, only in one direction around their rotation axes. Embodiments are not limited to these cases; it is permissible if the cleaning roller 34 or 134 and the charging roller 32 at least rotate around predetermined axes.

In the above-described embodiments, descriptions are given of cases where the embodiments are applied to the image forming apparatus 1 or 101 of the so-called direct transfer type in which the toner image is transferred from the photosensitive drum 14 directly onto the medium P. Embodiments are not limited to these cases; the embodiments may be applied also to an image forming apparatus of the so-called intermediate transfer type (or secondary transfer type) in which the toner image of each color is successively transferred from each photosensitive drum 14 onto an intermediate transfer belt in an overlaying manner and then the toner image is transferred from the intermediate transfer belt onto the medium P.

In the above-described embodiments, descriptions are given of cases where the embodiments are applied to the image forming apparatus 1 or 101 employing developing agents used for the one-component development method. Embodiments are not limited to these cases; the embodiments may be applied also to an image forming apparatus employing developing agents used for the two-component development method in which the toner is provided with an appropriate amount of electrification by mixing the toner with a carrier and using friction between the carrier and the toner. Incidentally, in the case of the development unit 12 according to the two-component development method, the downsizing of the photosensitive drum 14 or the development roller 20 leads to the narrowing of the dischargable range Rg for letting the toner fly towards the photosensitive drum 14, and thus the downsizing of the development unit 12 employing the two-component development method is difficult. Thus, it is preferable to apply the embodiments to the development unit 12 according to the one-component development method of which the downsizing is easy.

In the above-described embodiments, descriptions are given of cases where the embodiments are applied to the image forming apparatus 1 or 101 that includes four development units 12 and forms a color image by use of toners of four colors. Embodiments are not limited to these cases; the embodiments may be applied also to an image forming apparatus that includes three or less or five or more development units 12 and forms a color image by use of toners of a predetermined number of colors.

In the above-described embodiments, descriptions are given of cases where the embodiments are applied to the image forming apparatus 1 or 101 that is a single-function device as a printer. Embodiments are not limited to these cases; the embodiments may be applied also to an image forming apparatus having various other functions such as an MFP (Multi-Function Peripheral) having the functions of a copy machine and a facsimile machine, for example. The embodiments may be applied also to various types of electronic devices that form an image on a medium P such as paper by the electrophotographic method by using a developing agent.

Further, embodiments are not limited to the embodiments and the other embodiments described above. Namely, the scope of application of the embodiments ranges also to embodiments obtained by arbitrarily combining parts or wholes of some of the above-described embodiments and other embodiments and embodiments obtained by extracting parts from the above-described embodiments and other embodiments.

In the above-described first embodiment, a description is given of a case where the charging device 16 as a charging device is formed with the charging roller 32 as a charging member and the cleaning roller 34 as a cleaning member and the cleaning member is formed with the cleaning roller core bar 34*a* as a core bar, the foam member 34*d* as an elastic member and the core bar-side adhesive agent 34*c*1 as a first adhesive agent. Embodiments are not limited to this case; it is also possible to form the charging device with a charging member and a cleaning member having various other configurations and form the cleaning member with a core bar, an elastic member and a first adhesive agent having various other configurations.

In the above-described second embodiment, a description is given of a case where the charging device 116 as a charging device is formed with the charging roller 32 as a charging member and the cleaning roller 134 as a cleaning member. Embodiments are not limited to this case; it is also possible to form the charging device with a charging member and a cleaning member having various other configurations.

Embodiments are applicable to cases where an image is printed on a medium by using an image forming apparatus of the electrophotographic type.

4. Description of Reference Characters

1: image forming apparatus, 2: medium supply unit, 3: conveyance unit, 4: image forming section, 5: transfer unit, 6: fixing unit, 7: cassette, 8: hopping roller, 10, 11: conveyance roller pair, 12: development unit, 13: image forming unit, 14: photosensitive drum, 16, 116: charging device, 18: exposure device, 20: development roller, 22: toner supply unit, 24: cleaning blade, 26: transfer belt, 27: driven roller, 28: drive roller, 29: transfer roller, 30: cleaning blade, 32: charging roller, 32*a*: charging roller core bar, 32*b*: charging roller elastic layer, 34, 134, 234: cleaning roller, 34*a*: cleaning roller core bar, 34*b*, 134*b*: cleaning roller elastic layer, 34*d*G: foam member gap, 134*b*G: elastic layer gap, 34*c*, 134*c*: adhesive agent, 34*c*1: core bar-side adhesive agent, 34*c*2: foam member-side adhesive agent, 34*d*, 134*d*: foam member, 36: outside charging roller bearing, 38: compression spring, 40: inside charging roller bearing, 40*a*:

bearing arm, 42: cleaning roller bearing, 44: tension spring, 44*a*: tension spring arm, 44*b*: tension spring coil part, 46: heating roller, 48: pressure roller, 50: control section, 52: reception memory, 54: image data editing memory, 56: operation unit, 58: sensor group, 60: power supply circuit, 62: drive motor, 64: I/F control unit, 66: main control unit, 18S: exposure device control unit, 6S: fixation control unit, 3S: conveyance motor control unit, 62S: drive control unit, 32V: charging roller power supply, 20V: development roller power supply, 22V: toner supply unit power supply, 29V: transfer roller power supply, 61: glass slide, Gd: foam member winding interval, Gb: elastic layer winding interval, D: elastic layer thickness, P: medium.

What is claimed is:

1. A charging device, comprising:

a charging member that is rotatable and contacts and electrically charges a surface of a charging target member; and a cleaning member that is rotatable and cleans a surface of the charging member, wherein the cleaning member includes a core bar extending in a lengthwise direction, a foam member that is helically wound around the core bar while forming a gap in the lengthwise direction and contacts the charging member, a first adhesive agent that is provided between the foam member and the core bar, the first adhesive agent contacting a part of the foam member and another part of the foam member that are formed to adjoin each other in the lengthwise direction via the gap, and a second adhesive agent that is provided between the foam member and the core bar and has a width in the lengthwise direction less than a width of the foam member in the lengthwise direction so that the second adhesive agent is situated inside a range between an end and another end of the foam member in the lengthwise direction between the core bar and the foam member.

2. The charging device according to claim 1, wherein a width of the first adhesive agent in the lengthwise direction is greater than a width of the gap in the lengthwise direction.

3. The charging device according to claim 1, wherein a thickness D [mm] of the foam member and the first adhesive agent combined together and a bonding interval G [mm] of the foam member satisfy $$G \leq 0.578 \times D - 0.316.$$

4. The charging device according to claim 3, wherein the thickness D satisfies a relationship of 0.875 [mm] D 1.05 [mm].

5. The charging device according to claim 1, wherein the foam member is a urethane sponge whose density is 0.057±0.005 [g/cm$^3$] and whose number of cells is (55±10 pcs)/(25 mm).

6. The charging device according to claim 1, wherein a nip level of the cleaning member is greater than or equal to 0.4 [mm] and less than or equal to 0.5 [mm].

7. The charging device according to claim 1, wherein the first adhesive agent is a belt like first adhesive agent, the foam member is a belt-like foam member, and the cleaning member is made by sticking the belt-like first adhesive agent on a surface of a core bar by helically winding the belt-like first adhesive agent around the core bar while forming a first gap between opposite sides of the belt-like first adhesive agent in a lengthwise direction of the core bar, and bonding the belt-like foam member to the core bar by helically winding the belt-like foam member around the core bar so that the belt-like first adhesive agent contacts a part of the belt-like foam member and another part of the belt-like foam member that are formed to adjoin each other in the lengthwise direction of the core bar via a second gap.

8. An image forming unit comprising the charging device according to claim 1.

9. The image forming unit according to claim 8, wherein the image forming unit employs a one-component developing method by which a nonmagnetic one-component developing agent is used.

10. An image forming apparatus comprising the image forming unit according to claim 9.

11. A charging device comprising:

a charging member that is rotatable and contacts and electrically charges a surface of a charging target member; and a cleaning member that is rotatable and cleans a surface of the charging member, wherein the cleaning member is formed by winding a strip-like foam member and a strip-like adhesive agent around a core bar, and a thickness D [mm] of the foam member and the adhesive agent combined together and a bonding interval G [mm] of the foam member satisfy $G \leq 0.578 \times D - 0.316$.

12. The charging device according to claim 11, wherein the thickness D satisfies a relationship of 0.875 [mm] D 1.05 [mm].

13. A method of manufacturing a cleaning member, comprising:

sticking a belt-like first adhesive agent on a surface of a core bar by helically winding the belt-like first adhesive agent around the core bar while forming a first gap between opposite sides of the belt-like first adhesive agent in a lengthwise direction of the core bar; and bonding a belt-like foam member to the core bar by helically winding the belt-like foam member around the core bar so that the belt-like first adhesive agent contacts a part of the belt-like foam member and another part of the belt-like foam member that are formed to adjoin each other in the lengthwise direction of the core bar via a second gap and a belt-like second adhesive agent previously stuck on the belt-like foam member in a lengthwise direction of the belt-like foam member is stuck on the first gap formed on the core bar by the belt-like first adhesive agent.

* * * * *